US008335627B2

(12) United States Patent
Cho et al.

(10) Patent No.: US 8,335,627 B2
(45) Date of Patent: Dec. 18, 2012

(54) METHOD AND APPARATUS FOR CONTROL AND SAFE BRAKING IN PERSONAL RAPID TRANSIT SYSTEMS WITH LINEAR INDUCTION MOTORS

(75) Inventors: Hyoung Min Cho, Seongnam-si (KR); Sun Wook Lee, Seoul (KR); Woo Je Kim, Seoul (KR); Kyung Hoon Kim, Seoul (KR)

(73) Assignee: POSCO, Pohang-si (KR)

( * ) Notice: Subject to any disclaimer, the term of this patent is extended or adjusted under 35 U.S.C. 154(b) by 982 days.

(21) Appl. No.: 12/299,789

(22) PCT Filed: May 11, 2007

(86) PCT No.: PCT/KR2007/002301

§ 371 (c)(1),
(2), (4) Date: Nov. 6, 2008

(87) PCT Pub. No.: WO2007/133008

PCT Pub. Date: Nov. 22, 2007

(65) Prior Publication Data

US 2009/0099715 A1 Apr. 16, 2009

(30) Foreign Application Priority Data

May 11, 2006 (WO) ..... PCT/KR2006/001761

(51) Int. Cl.
*B60T 7/12* (2006.01)
*B60T 8/88* (2006.01)

(52) U.S. Cl. ..... 701/97; 701/19; 701/20; 701/93; 701/96; 701/117; 246/182 R; 246/182 B

(58) Field of Classification Search ..... 701/19, 701/20, 45, 93, 70, 96, 97, 116, 117, 301; 246/182 R, 182 B, 182 C, 167 D; 104/118, 104/120, 295–301; 105/141, 148, 149.1; 714/51, 55

See application file for complete search history.

(56) References Cited

U.S. PATENT DOCUMENTS

| | | | | |
|---|---|---|---|---|
| 4,965,583 | A * | 10/1990 | Broxmeyer | 342/42 |
| 5,467,945 | A | 11/1995 | Kubota et al. | |
| 6,029,104 | A * | 2/2000 | Kim | 701/20 |
| 2007/0192000 | A1 * | 8/2007 | Ellmann et al. | 701/29 |

FOREIGN PATENT DOCUMENTS

| | | | |
|---|---|---|---|
| CN | 1173851 | A | 2/1998 |
| JP | 63157606 | A | 6/1988 |

(Continued)

*Primary Examiner* — Khoi Tran
*Assistant Examiner* — Spencer Patton
(74) *Attorney, Agent, or Firm* — The Webb Law Firm

(57) ABSTRACT

A speed control system for controlling vehicle speed of one or more vehicles in a personal rapid transit system when the one or more vehicles travel along a track, the personal rapid transit system including a vehicle propulsion system including one or more motors, each motor being adapted to generate a thrust for propelling one of the one or more vehicles. The speed control system includes: a speed regulation subsystem adapted to control the thrust generated by at least one of said motors based on one or more sensor signals received from vehicle position and/or speed sensors, so as to control the speed of the one or more vehicles; and a vehicle control system included in each of said one or more vehicles and adapted to activate, independently from the speed regulation subsystem, an emergency brake mounted on said vehicle.

47 Claims, 9 Drawing Sheets

FOREIGN PATENT DOCUMENTS

| | | | | |
|---|---|---|---|---|
| JP | 6296305 | A | | 10/1994 |
| JP | 8289415 | A | | 11/1996 |
| JP | 2001128302 | A | | 5/2001 |
| JP | 2001157316 | A | | 6/2001 |
| KR | 19990012348 | A | | 2/1999 |
| KR | 20050050948 | A | | 6/2005 |
| WO | 9717244 | A1 | | 5/1997 |
| WO | 9958387 | A1 | | 11/1999 |
| WO | WO 2004098970 | A1 | * | 11/2004 |
| WO | WO 2005095145 | A1 | * | 10/2005 |

* cited by examiner

[Fig. 1]
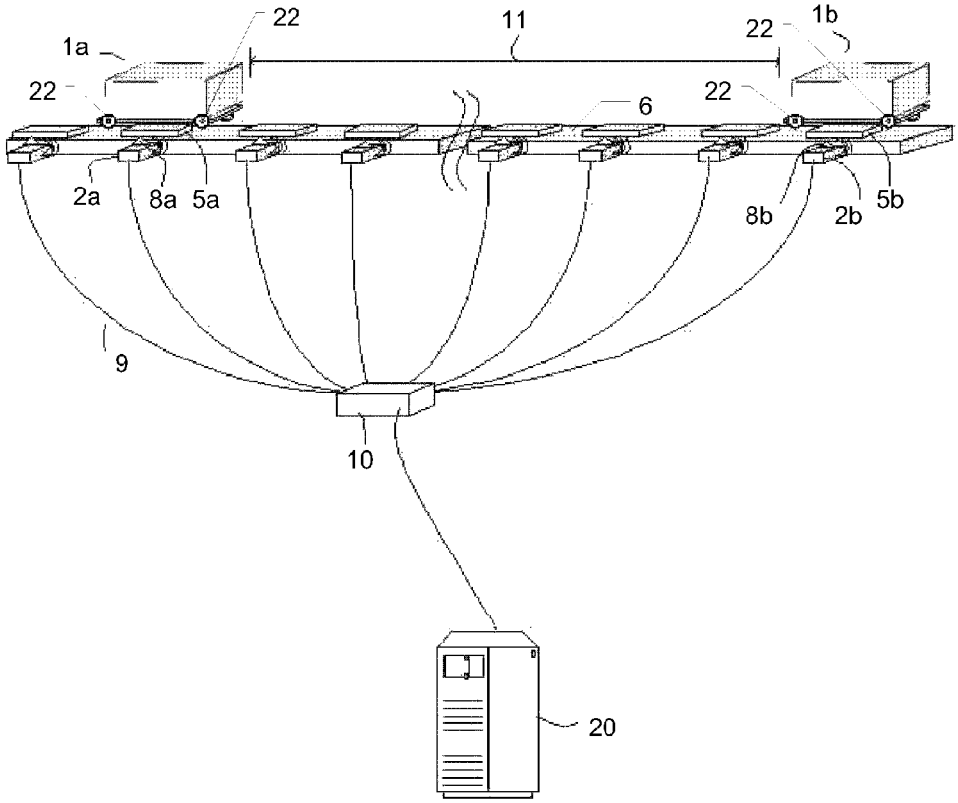
[Fig. 2]
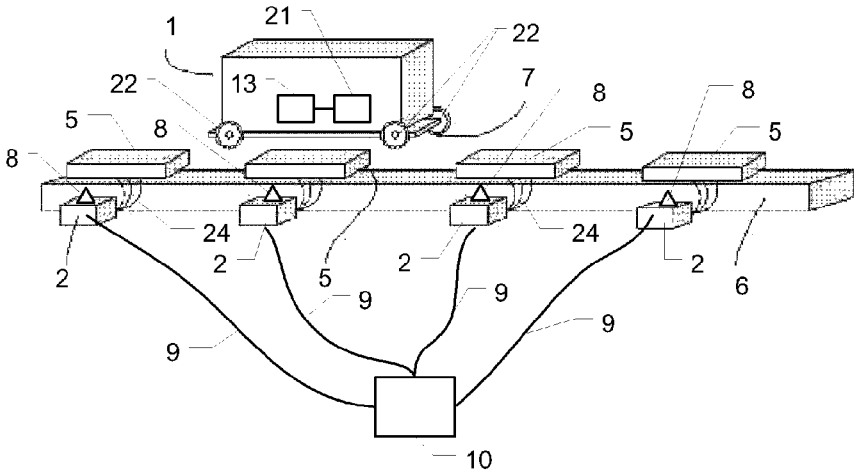

[Fig. 3]
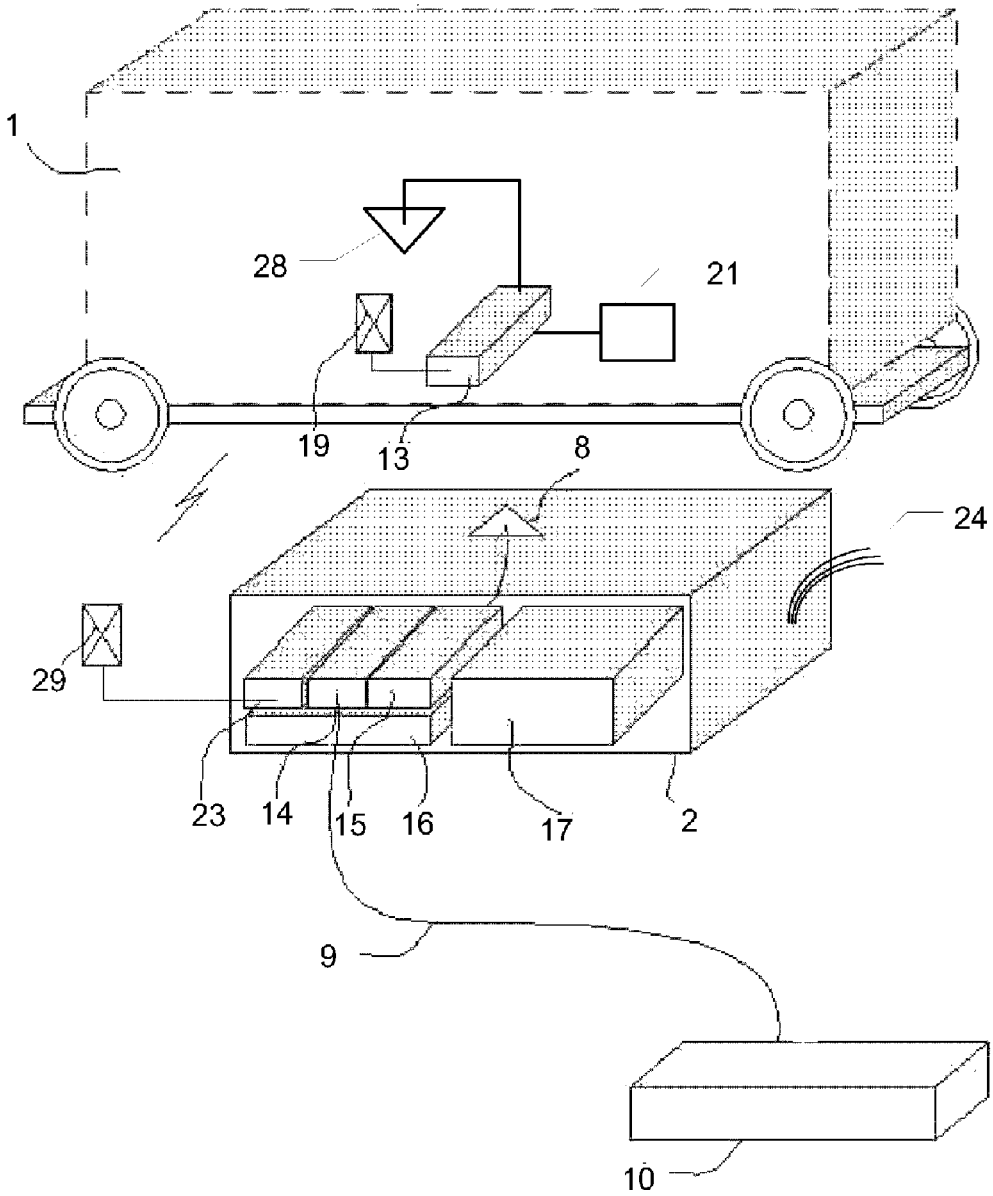

[Fig. 4]
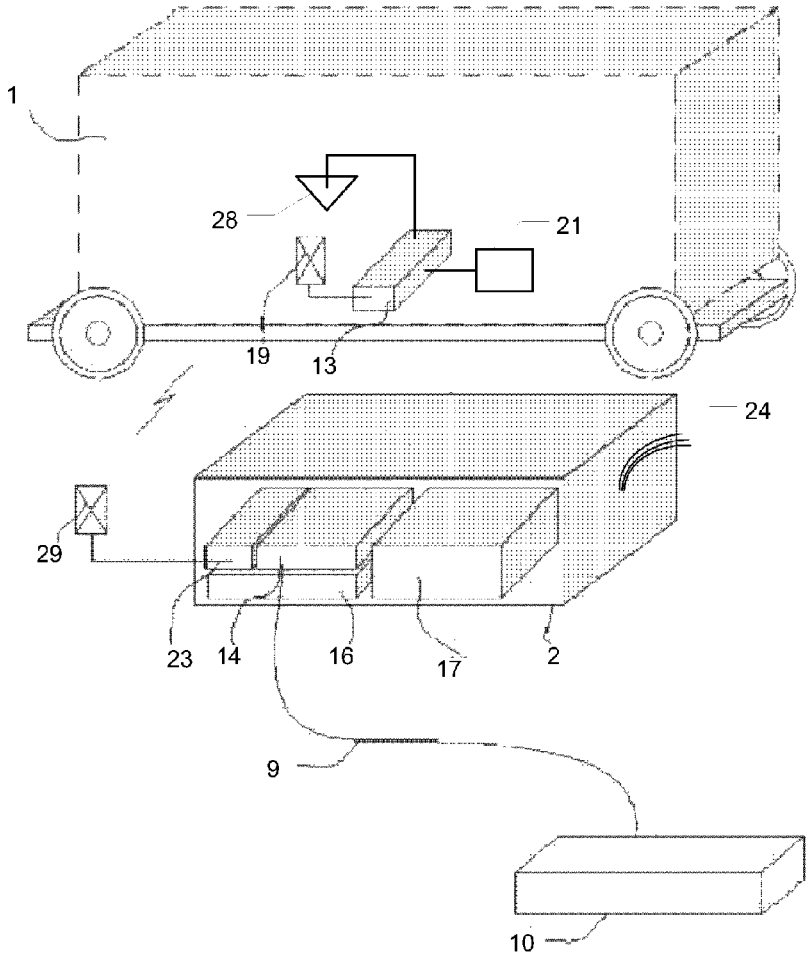
[Fig. 5]
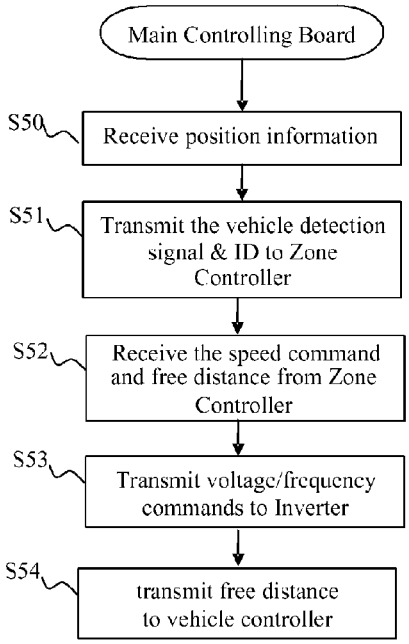

[Fig. 6]
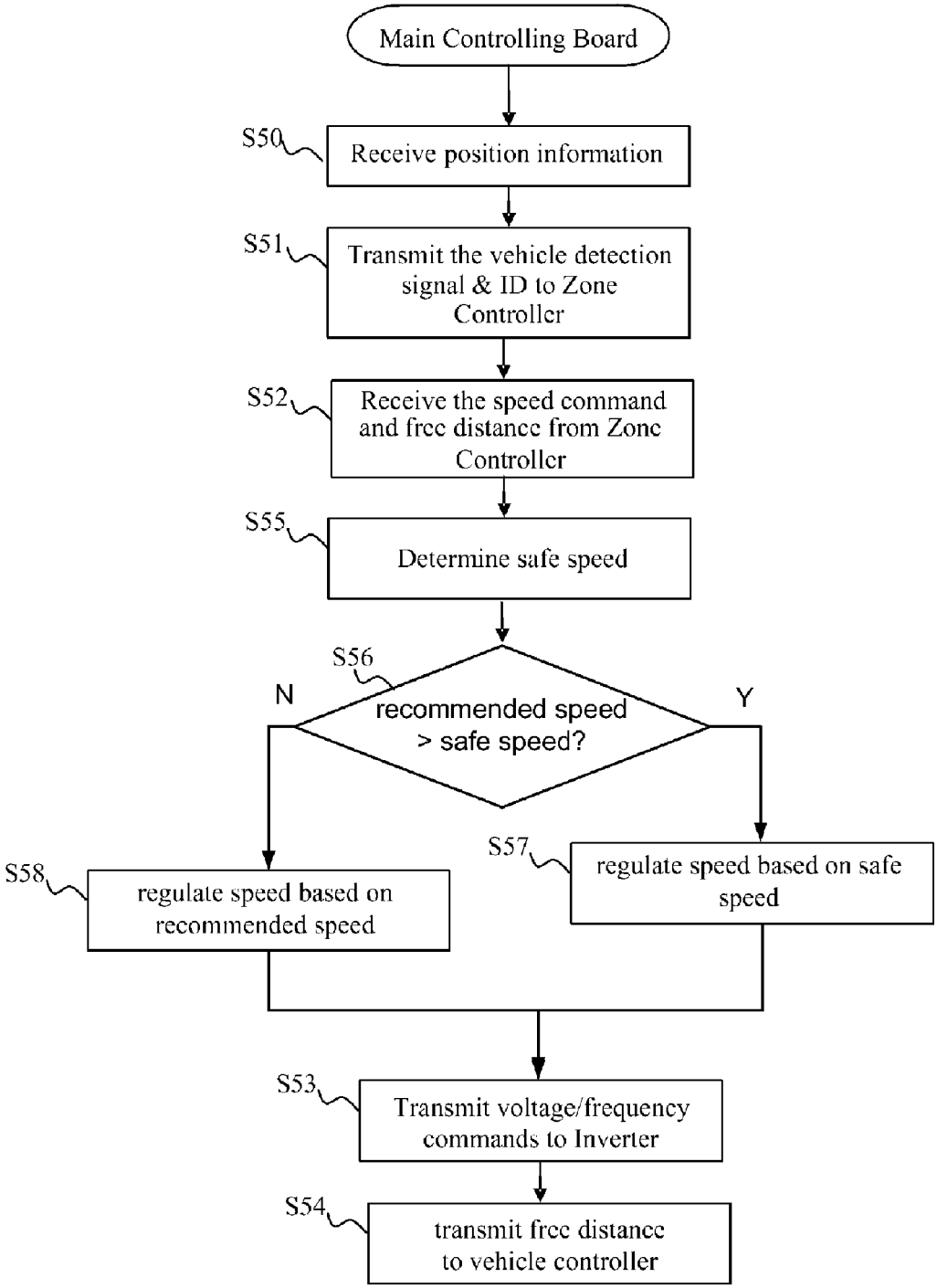

[Fig. 9]
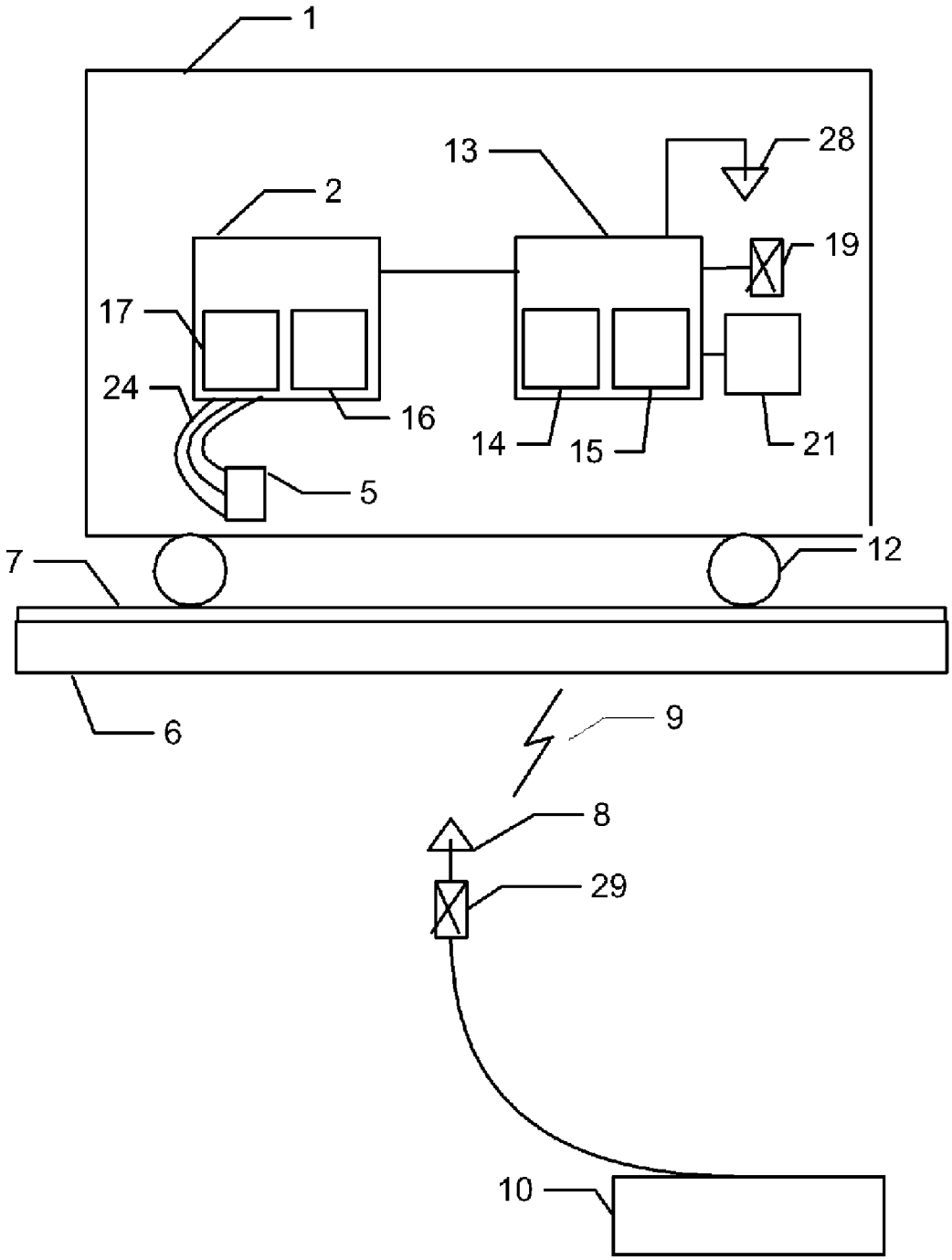

[Fig. 10]
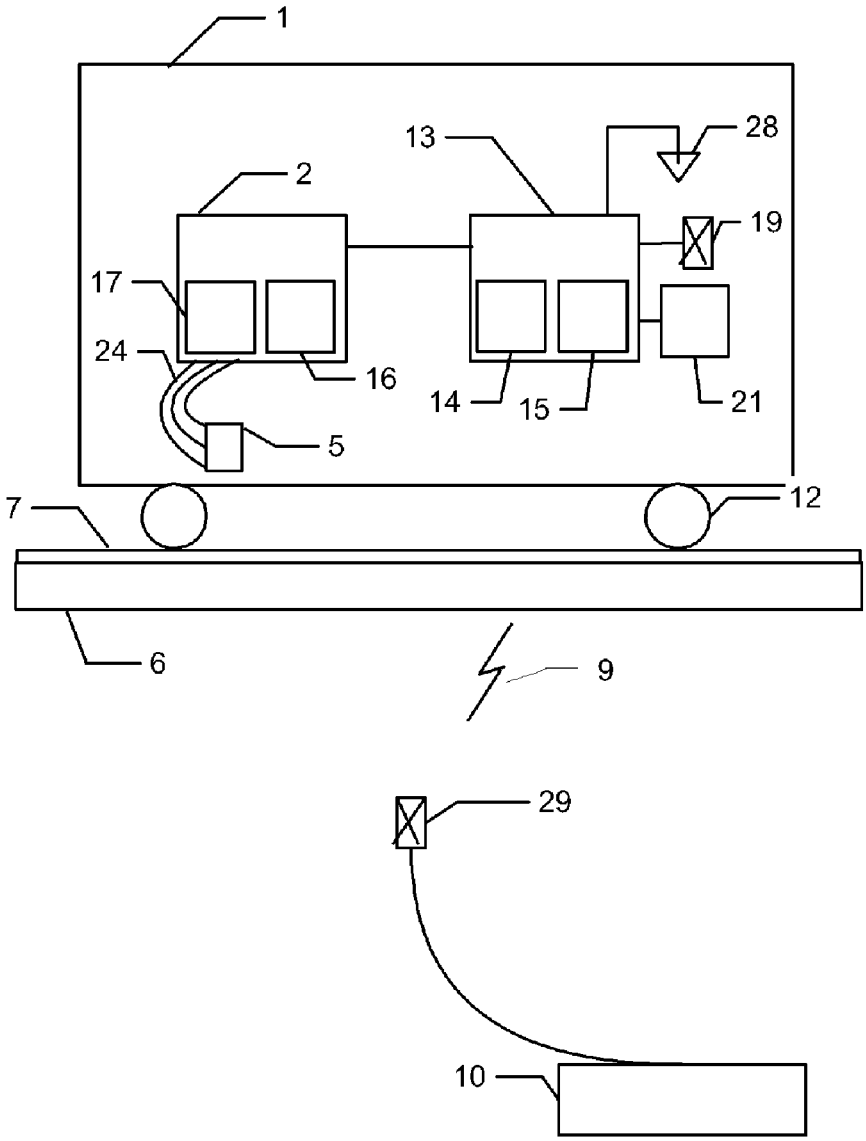
[Fig. 11]
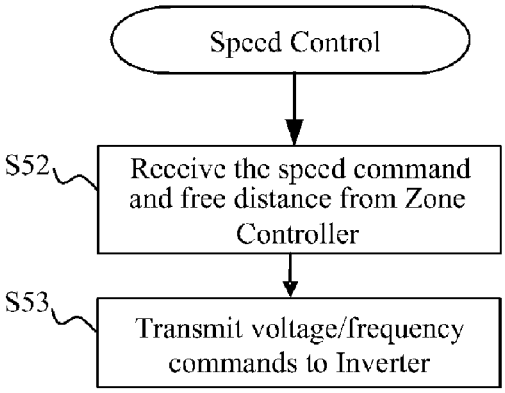

[Fig. 12]
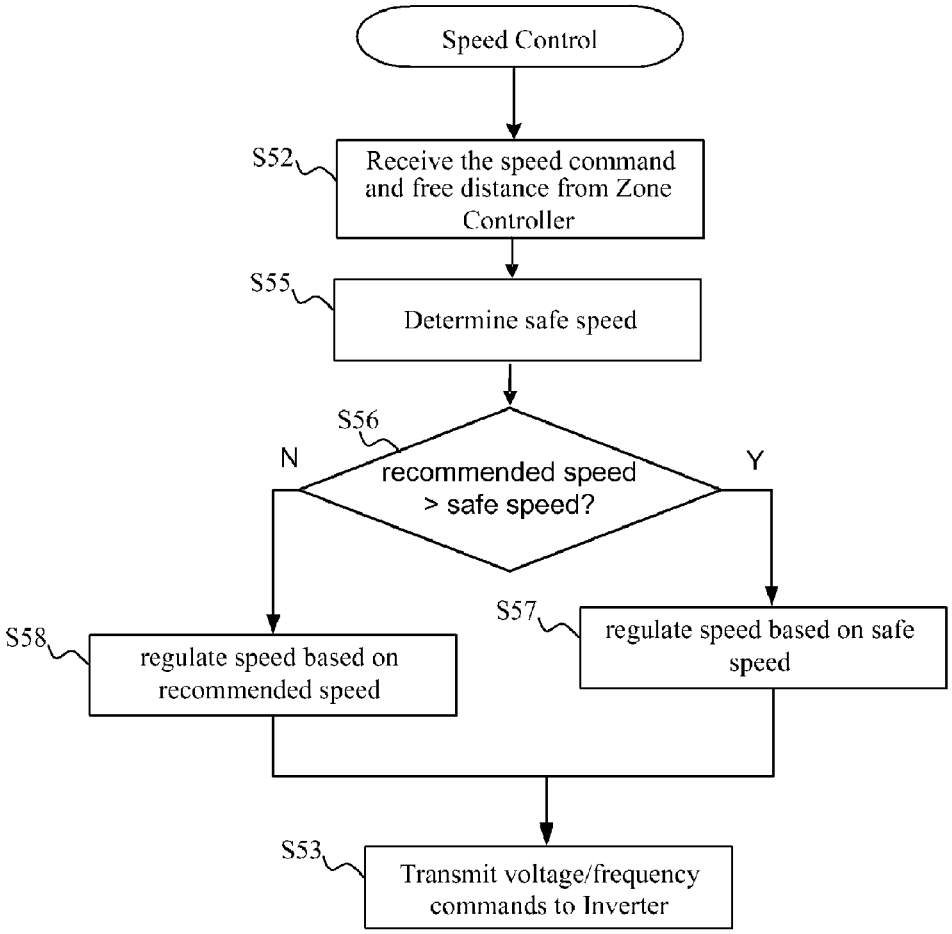
[Fig. 13]
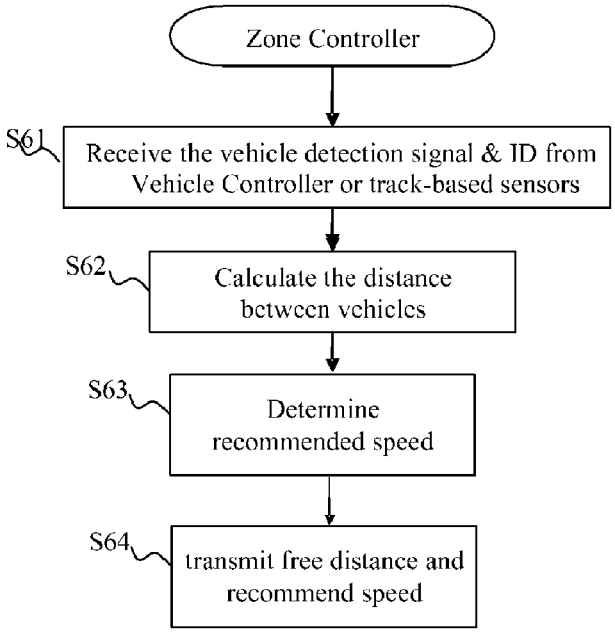

METHOD AND APPARATUS FOR CONTROL AND SAFE BRAKING IN PERSONAL RAPID TRANSIT SYSTEMS WITH LINEAR INDUCTION MOTORS

TECHNICAL FIELD

The present innovation relates to speed control and, in particular, safe braking in so called Personal Rapid Transit systems (referred to as "PRT") propelled by linear induction motors, and more particularly to such a method and apparatus which is robust towards failures in hardware, software and communication.

BACKGROUND ART

Personal rapid transit systems include small vehicles offering individual transport service on demand. This invention relates to personal rapid transit systems with vehicles running on wheels along a track by the propelling power of linear induction motors (LIM) mounted either in the track or on-board the vehicle. Normally each vehicle carries 3 or 4 passengers. Therefore, the vehicle is compact and light which in turn allows the PRT guide-way (track) structure to be light compared with conventional railroad systems such as conventional tramways or metro systems. Therefore, the construction cost of the PRT system is much lower than that of alternative solutions. A PRT system is friendlier to the environment, since it has less visual impact and generates low noise, and it does not produce local air pollution. Further, PRT stations can be constructed inside an existing building. On the other hand, since the headway/free distance may be kept comparably short, the traffic capacity of a PRT system is comparable with the existing traffic means such as bus and tramway.

DISCLOSURE OF INVENTION

Technical Problem

Generally a PRT system includes a speed control system for controlling speed and distance between vehicles. Failures in hardware or communication, software errors and loss of power may cause loss of vehicle control. For this reason it is desirable to provide a reliable and safe control system.

SUMMARY OF THE INVENTION

According to one aspect, the above and other problems are solved by a speed control system for controlling vehicle speed of one or more vehicles in a personal rapid transit system when said one or more vehicles travel along a track, the personal rapid transit system including a vehicle propulsion system including one or more motors, each motor being adapted to generate a thrust for propelling one of the one or more vehicles, the speed control system comprising:

a speed regulation subsystem adapted to control the thrust generated by at least one of said motors based on one or more sensor signals received from vehicle position and/or speed sensors, so as to control the speed of the one or more vehicles;

a vehicle control system included in each of said vehicles and adapted to activate, independently from the speed control by the speed regulation subsystem, an emergency brake mounted on said vehicle.

In one embodiment a speed control system for controlling vehicle speed is provided wherein the personal rapid transit system includes an in-track vehicle propulsion system including a plurality of motors positioned along said track, each motor being adapted to generate a thrust for propelling one of the one or more vehicles, when said vehicle is in a proximity of said motor.

In another embodiment a speed control system for controlling vehicle speed is provided, wherein the personal rapid transit system includes an on-board type vehicle propulsion system, wherein each vehicle comprises at least one of said motors. On-board propulsion is often less costly with fewer motors and facilitates smooth control although it requires transmission of power to each vehicle.

Consequently, the normal control of vehicle speed and inter-vehicle distances is performed by a speed regulation subsystem that controls the thrust generated by the motors, which are either placed in the track or on-board each vehicle. Such control may be based on track-mounted or vehicle-mounted sensors detecting vehicle position and speed, and on zone controllers generating speed commands for each vehicle for controlling the thrust of the LIM or LIMs under or on the respective vehicle. The speed command may be sent to respective motor controllers or to vehicle mounted vehicle controllers, via wired or wireless communication.

Each vehicle includes a vehicle control system, that controls an emergency brake, e.g. a mechanical emergency brake acting on the guideway. Preferably, the vehicle control system is operable independently from the normal speed control performed by the speed regulation system and adapted to activate the emergency brake at its own initiative, preferably without access to power, in particular without power from the guideway.

It is an advantage of the system described herein that it is sufficient to dimension the motors for normal speed regulation rather than having to dimension them sufficiently strong for emergency braking. It is a further advantage that the system includes an emergency brake mechanism which is activated in such a way that accidents can reliably be avoided even when some component or software fails.

In particular, it is an advantage of the system described herein that it provides a safe emergency braking mechanism which avoids the cost of doubling power supply and motors.

It is a further advantage of the system described herein that it ensures safe braking in most failure modes of hardware, power supply, communication and software.

In some embodiments, the speed regulation subsystem includes one or more motor controllers, wherein each motor controller is adapted to control at least one of the one or more motors; and at least one zone controller adapted to receive said sensor signals and to generate speed commands for causing motor controllers to adjust the speed of respective vehicles. In an in-track system, when the communication between zone controller and sensors and/or between zone controller and motor controller is based on wired communication, a particularly reliable communication is provided.

In a preferred embodiment the emergency brake comprises a preloaded spring which is held back by a preload pressure, e.g. a hydraulic pressure, as long as everything is working normally.

The communication to the vehicle in connection with the emergency brake system is typically based on wireless communication. However, wireless communication may fail. Correspondingly, in some embodiments, the vehicle control system receives recurrent, e.g. periodic, OK signals and activates the emergency brake after a preset delay if signals disappear. It is an advantage of the system described herein that it reduces the risk of accidental braking caused by temporary disturbances of short duration. In some embodiments, the delay depends on the speed of the vehicle so that the vehicle still can stop within a predetermined distance.

In yet another embodiment, the vehicle control system receives periodic messages indicative of a remaining free distance, i.e. messages indicative of how far the vehicle is allowed to move. Furthermore, the vehicle control system keeps track of its own position and speed and determines whether to apply the emergency brake. For example, the vehicle can determine its own position and speed by guideway transponders and wheel sensors. The vehicle control system calculates the vehicle position and speed and determines the need for braking based on the remaining distance and current speed.

The received messages may indicate the free distance directly as a relative distance, e.g. in meters or another suitable unit length. Alternatively, the received messages may indicate an end point of the free distance ahead of the vehicle, thereby providing a reliable indication of the actual free distance that is independent of the exact position and speed of the vehicle and independent of any delays in the distance calculation and data communication. It is understood, however, that other measures of the free distance may be provided, e.g. as a travel time at the current vehicle speed until the end of the free distance is reached, or the like.

A failure in a zone controller, communication or motor controller or the wireless communication to the vehicle would stop new messages so that the allowed free distance is not extended and the vehicle will stop. It is an advantage of this embodiment that it reduces the risk of unnecessary stopping due to short communication interrupts.

The effect of guideway sensor failures can be reduced by requiring two sensors indicating a free track distance before the vehicle control system considers the distance to be free.

Position and speed can also be measured by sensors on one or more vehicle wheels in combination with markers in the guideway.

The effect of software errors can be eliminated by the introduction of double zone controllers and motor controllers and vehicle controllers with different software or different software modules in the same hardware.

The effect of a failure in the vehicle controller may be further reduced by including a watchdog function between vehicle controller and brake activator. If the vehicle controller does not send OK signals then the brake will apply after a predetermined delay.

Advantageous effects of embodiments described herein include:

- Enhanced level of safety by a vehicle-based system for emergency braking not depending on power and commands from outside.
- Reduced risk for unnecessary braking due to a confirmed free distance being known at each time.
- Not need for doubling power supply, motors and communication channels.
- Can be combined with doubling of components for increased reliability.

The present invention relates to different aspects including the control system described above and in the following, a vehicle, a rapid transit system, and method, each yielding one or more of the benefits and advantages described in connection with the above-mentioned control system, and each having one or more embodiments corresponding to the embodiments described in connection with the above-mentioned system.

More specifically, according to another aspect, a vehicle is provided for a personal rapid transit system, the personal rapid transit system including a vehicle propulsion system including one or more motors, each motor being adapted to generate a thrust for propelling the vehicle, the rapid transit system further comprising a speed regulation subsystem adapted to control the thrust generated by at least one of said motors so as to control the speed of the vehicle based on one or more sensor signals received from position and/or speed sensors in the vehicle or in the guideway. The vehicle comprises: a vehicle control system included in said vehicle and adapted to activate, independently from the speed control by the speed regulation subsystem, an emergency brake mounted on said vehicle.

According to another aspect, a rapid transit system includes a speed control system as defined in any one of claims 1 through 44.

According to yet another aspect, a method is provided of controlling vehicle speed of one or more vehicles in a personal rapid transit system when said one or more vehicles travel along a track, the personal rapid transit system including a vehicle propulsion system including one or more motors, each motor being adapted to generate a thrust for propelling one of the one or more vehicles. The method comprises:

- detecting at least a position of one of the one or more vehicles;
- controlling the thrust generated by at least one of said motors so as to control the speed of the one or more vehicles based on at least said sensor signal;
- providing a vehicle control system included in said vehicle and adapted to activate, independently from said speed control, an emergency brake mounted on said vehicle.

In some embodiments of the above aspects, the personal rapid transit system includes an in-track type vehicle propulsion system including a plurality of motors positioned along said track, each motor being adapted to generate a thrust for propelling the vehicle when said vehicle is in a proximity of said motor.

In alternative embodiments of the above aspects, the personal rapid transit system includes an on-board type vehicle propulsion system including one or more motors positioned on the vehicle.

According to another aspect, a speed control system for controlling vehicle speed in a personal rapid transit system comprises:

a) a linear induction motor including one or more primary cores, each primary core being arranged to provide propulsion to a vehicle moving along a track;

b) one or more vehicle position sensors in the guideway or on each vehicle adapted to detect at least a position of the vehicle and/or speed/distance sensors on each vehicle;

c) one or more motor controllers, wherein each motor controller is adapted to control respective one or more of the primary cores of the linear induction motor; and d) a zone controller adapted to identify the position of each vehicle in a predetermined zone based on data received from the vehicle position sensors, to compute the distance between two consecutive vehicles and to generate vehicle speed commands for causing one or more of the motor controllers to adjust the speed of respective vehicles so as to maintain a safe headway between consecutive vehicles and/or to optimize vehicle flow in said zone.

In one embodiment a speed control system is provided, wherein the speed control system comprises:

the linear induction motor including a plurality of primary cores arranged along a track, the vehicle carrying the reaction plate;

a plurality of motor controllers, wherein the motor controllers are arranged along the track.

In one embodiment a speed control system is provided, wherein the speed control system comprises:

the linear induction motor including one or more primary cores arranged in each vehicle, the track carrying the reaction plate;

one or more motor controllers arranged in each vehicle.

Accordingly, according to a further aspect, a method is provided for controlling vehicle speed in personal rapid transit system having a linear induction motor including one or more primary cores for generating electromagnetic thrust to the reaction plate, the primary cores being controlled by respective motor controllers, the method comprising the steps of:

a) detecting the position and speed of the respective vehicles;

b) communicating the detected positions and speeds to a zone controller;

c) computing the distance between the vehicles by a zone controller based on the detected positions of the vehicles; and d) instructing at least one of the motor controllers by the zone controller to adjust the speed of at least one vehicle in accordance with the computed distance between the vehicles.

In one embodiment a method of controlling vehicle speed is provided, wherein the linear induction motor includes a plurality of primary cores arranged along the track, the method comprising the steps of:

detecting the position of the respective vehicles at least at each position of the primary cores;

communicating the detected positions to a zone controller by at least one of the motor controllers.

In one embodiment a method of controlling vehicle speed is provided, wherein the one or more primary cores are arranged in each vehicle.

Hence, methods and systems described herein provide reliable and efficient control of a plurality of vehicles in a personal rapid transit system with either in-track type or on-board type linear induction motor. In particular, the reliability of the emergency brake does not critically depend on a wireless communications link in the emergency brake system.

BRIEF DESCRIPTION OF THE DRAWINGS

These and/or other aspects and advantages of the invention will become apparent and more readily appreciated from the following description of preferred embodiments, taken in conjunction with the accompanying drawings of which:

FIGS. 1 and 2 schematically show an example of a part of a personal rapid transit system with in-track type linear induction motor;

FIGS. 3 and 4 schematically show more detailed views of examples of a speed control system for controlling vehicle speed in a personal rapid transit system;

FIGS. 5 and 6 show flow diagrams of examples of a speed control process performed by a motor controller of a speed control system;

FIGS. 9 and 10 schematically show an example of a speed control system for controlling vehicle speed in a personal rapid transit system;

FIGS. 11 and 12 show flow diagrams of examples of a speed control process performed by a motor controller of a speed control system;

FIG. 13 shows a flow diagram of an example of a speed control process performed by a zone controller of a speed control system;

In the drawings, like reference numerals refer to like or corresponding features, elements, steps etc. Furthermore, when one element is connected to another element, the elements may not only be directly connected to each other but also indirectly connected to each other via an intermediate element.

DETAILED DESCRIPTION OF THE INVENTION

Figure 7:
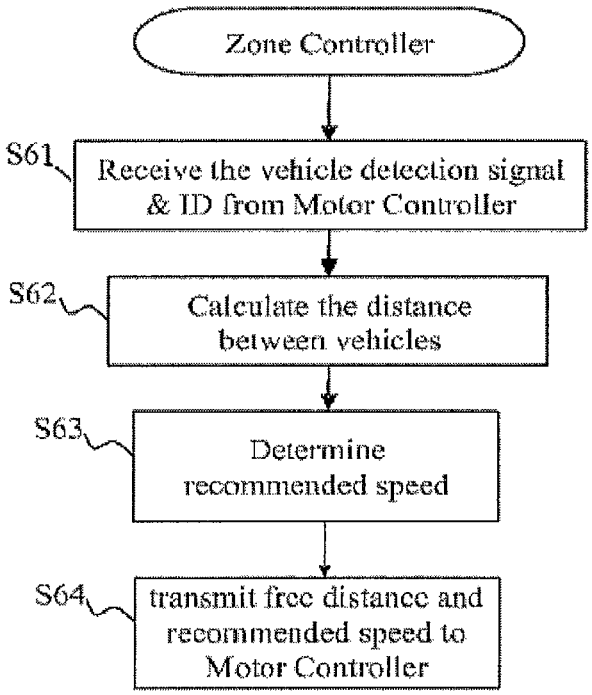
FIG. 7 shows a flow diagram of an example of a speed control process performed by a zone controller of a speed control system.

In-track Type Linear Induction Motor:

FIGS. 1 and 2 schematically show an example of a part of a personal rapid transit system with in-track type linear induction motor. The personal rapid transit system comprises a track, a section of which is shown in FIGS. 1 and 2 designated by reference numeral 6. The track typically forms a network, typically including a plurality of merges, diverges and stations. The personal rapid transit system further includes a number of vehicles, generally designated by reference numeral 1. FIG. 1 shows a track section 6 with two vehicles 1*a* and 1*b*, while FIG. 2 shows an enlarged view of a single vehicle 1. Even though only two vehicles are shown in FIG. 1, it is understood that a personal rapid transit system may include any number of vehicles. Generally, each vehicle typically includes a passenger cabin supported by a chassis or framework carrying wheels 22. An example of a PRT vehicle is disclosed in international patent application WO 04/098970, the entire contents of which are incorporated herein by reference.

As mentioned above, the personal rapid transit system comprises an in-track type linear induction motor including a plurality of primary cores, generally designated by reference numeral 5, periodically arranged in/along the track 6. In FIG. 1 vehicles 1*a* and 1*b* are shown in locations above primary cores 5*a* and 5*b*, respectively. Each vehicle has a reaction plate 7 mounted at a bottom surface of the vehicle. The reaction plate 7 is typically a metal plate made from aluminium, copper, or the like on a steel backing plate.

One or more primary cores 5 are controlled by a motor controller 2 which supplies a suitable AC power to the corresponding primary core so as to control the thrust for accelerating or decelerating the vehicle. The thrust is imparted by the primary core 5 on the reaction plate 7, when the reaction plate is located above the primary core. To this end, each motor controller 2 includes an inverter or switching device, e.g. a solid state relay (SSR) for switching current (phase angle modulation), that feeds a driving power to the primary core 5. The motor controller 2 controls the voltage/frequency of the driving power in accordance with an external control signal 9. Generally, the electro-magnetic thrust generated between the plate 7 and the primary core 5 is proportional to the area of the air gap between the plate and the primary core, if conditions such as the density and the frequency of flux are the same. Motor controllers may be positioned adjacent to each primary core or in a cabinet which is easier to access for maintenance. In the latter case one motor controller may be switched to control several primary cores. It is an advantage of in-track linear induction motors that the primary core 5 and the motor controller 2 are mounted on the stationary track or guideway, thereby avoiding the need for providing electrical driving power to the vehicle 1.

The system further comprises a plurality of vehicle position detection sensors for detecting the position of the vehicles along the track. In the system of FIGS. 1 and 2, vehicle position is detected by vehicle position sensors 8, adapted to detect the presence of a vehicle in a proximity of the respective sensors. Even though the vehicle position sensors 8 in FIGS. 1 and 2 are shown arranged along the track 6 together with the plurality of the primary cores 5, other positions of vehicle position sensors are possible. In particular, as will be described in greater detail below, each vehicle may include one or more vehicle position detection sensors such that each vehicle transmits position and speed to the motor controllers as measured by in-vehicle sensors.

The vehicle position sensors may detect the vehicle presence by any suitable detection mechanism. In preferred embodiments, the vehicle position sensors detect further parameters such as vehicle speed, direction, and/or the ID of a guideway marker.

Generally, it is understood that the primary cores may be positioned at constant intervals along the track or with varying intervals between the primary cores. For example, in areas where a higher propulsion is desired, e.g. at inclines or in acceleration/deceleration zones e.g. at the entrances or exits of stations, correspondingly shorter intervals may be chosen. It is understood that the terms propelling and propulsion as used herein are intended to refer to propulsion for the purpose of both acceleration, maintenance of a constant speed, and deceleration.

In some embodiments the arrangement period of the primary cores 5, i.e the sum of the length of a first primary core and the length of the gap between the first primary core and an adjacent primary core, is substantially identical to the length of the reaction plate 7. This arrangement prevents flickering of the vehicle speed caused by thrust fluctuations due to changes of the active air gap between reaction plate and primary core. It is understood that the arrangement period of the plurality of primary cores does not necessarily have to be exactly identical to the length of the reaction plate, but that the arrangement period of the plurality of primary cores may be formed within an error range of e.g. ±15% of the length of the reaction plate. Furthermore, the arrangement period may be selected to be smaller than the length of the reaction plate, e.g. at least within a part of the track as small as, e.g. a predetermined fraction such as ½, ⅓, etc. of the length of the reaction plate.

The system further comprises one or more zone controllers 10 for controlling operation of at least a predetermined section or zone of the PRT system. Each zone controller is connected with the subset of the motor controllers 2 within the zone controlled by the zone controller 10 so as to allow data communication between each of the motor controllers 2 with the corresponding zone controller 10, e.g. by means of a wired communication through, a point-to-point communication, a bus system, a computer network, e.g. a local area network (LAN), or the like. Even though FIG. 1 only depicts a single zone controller, it is understood that a PRT system normally includes any suitable number of zone controllers. Different parts/zones of the system may be controlled by their respective zone controllers, thereby allowing an expedient scaling of the system as well as providing operation of the individual zones independently of each other. Furthermore, though not depicted in FIGS. 1 and 2, each zone controller 10 may be constructed as a plurality of individual controllers so as to provide a distributed control over motor controllers in a zone, e.g. the motor controllers of a predetermined part of a track. Alternatively or additionally, a plurality of zone controllers may be provided for each zone so as to enhance the reliability through redundancy, or to provide a direct communication path to different groups of zone controllers.

As will be described in greater detail below, the zone controller 10—upon receipt of a suitable detection signal from a motor controller indicating the position and the vehicle ID of a detected vehicle—recognizes the position of each vehicle (1;1*a*,1*b*). As an alternative, position and speed can be received directly from the vehicle.

Furthermore, the zone controller computes the distance between two vehicles, as indicated by distance 11 between vehicles 1*a* and 1*b*. The zone controller 10 thus determines respective desired/recommended speeds of the vehicles 1*a*, 1*b* in accordance with the computed distance 11 between the two vehicles, so as to maintain a desired minimum headway or safe distance between vehicles and so as to manage the overall traffic flow within the dedicated zone. The zone controller thus returns information about the free distance and the desired/recommended speed of a detected vehicle to the motor controller at the location at which the vehicle was detected. Alternatively, the zone controller may determine a desired degree of speed adjustment and transmit a corresponding command to the motor controller.

Alternatively or additionally, speed may also be calculated by the motor controller based on a confirmed free distance. Thus, safe control does not depend on uninterrupted communication with the zone controller, since the motor controller may calculate the speed based on the last known free distance for the vehicle.

The PRT system further comprises a central system controller 20 connected to the zone controllers 10 so as to allow data communication between the zone controllers and the central system controller 20. The central system controller 20 may be installed in the control center of the PRT system and be configured to detect and control the running state of the overall system, optionally including traffic management tasks such as load prediction, routeing tables, empty vehicle management, passenger information, etc.

As will be described in greater detail below, each vehicle 1 includes a vehicle controller, generally designated 13, for controlling operation of the vehicle. In particular, the vehicle controller 13 controls operation of one or more emergency brakes 21 installed in the vehicle 1. Even though other types of emergency brakes may be used, a mechanical emergency brake of the preloaded spring type has proven particularly reliable, as it does not require electrical or other power to be activated, thus providing a fail-safe emergency brake mechanism. In such a preloaded spring emergency brake, a spring is preloaded, e.g. by means of hydraulic or pneumatic pressure. The brake is actuated by removing the preload pressure thus causing the spring to expand and activate the brake, e.g. by pressing one or more brake blocks or clamps against the track 6 and/or the wheels 22.

FIGS. 3 and 4 schematically show more detailed views of examples of a speed control system for controlling vehicle speed in a personal rapid transit system. While FIG. 3 shows a system based on in-track vehicle position detection sensors, FIG. 4 shows a system based on on-board vehicle position sensors.

Initially referring to FIG. 3, the speed control system includes the motor controller 2 and vehicle position sensor 8 positioned on the track (not explicitly shown in FIGS. 3 and 4), the vehicle controller 13 included in the vehicle 1, and the zone controller 10, as described above.

The motor controller 2 comprises a communication modem for wired data communication, a transceiver and/or another communications interface 14 for transmitting/receiving data to/from the zone controller 10 via communication cable 9. The motor controller 2 further includes a main control module 16 for outputting voltage/frequency commands to an inverter 17 or other thrust controller, e.g. an inverter or a switching device, in accordance with the instructions received via modem 14 from the zone controller 10. The motor controller 2 further includes a signal processing module 15 and the inverter 17 or switching device for supplying multi-phase AC power via power lines 24 to a corresponding primary core (not explicitly shown in FIGS. 3 and 4) in accordance with the voltage/frequency commands from the main control module 16. The signal processing module 15 and the main control module 16 may be implemented as separate circuits/circuit boards or as a single circuit/circuit board, e.g. as an ASIC (Application Specific Integrated Circuit), a suitably programmed general purpose microprocessor, and/or the like.

The vehicle detecting sensor 8 is adapted to detect the presence, direction, speed, and ID of a vehicle 1 when the vehicle is in a predetermined proximity of the sensor 8 and to forward the sensor signal to the signal processing circuit 15. The vehicle position sensor 8 may include one sensor or a number of separate sensors, e.g. separate sensors for position detection, speed, etc. The vehicle position sensors may detect the vehicle presence by any suitable detection mechanism, e.g. by means of an inductive sensor, an optical sensor, a transponder, by means of a radio frequency identification (RFID) tag mounted on the vehicle, or any other suitable sensor or combination of sensors. In preferred embodiments, the vehicle position sensors detect further parameters such as vehicle speed, direction, and/or a vehicle ID. For example, vehicle speed and direction may be detected by two spaced-apart sensors that each detects the presence of the vehicle so as to determine a time delay between arrivals of the vehicle at the respective sensors. The vehicle ID may be detected by means of an RFID tag or other short-range wireless radio communication, by means of a bar code reader or any other suitable mechanism. Also other types of presence detection equipments can be used.

Even though other placements are possible, a positioning of the detection sensors 8 in a predetermined spatial relationship to the primary cores 5 facilitates a control of the primary cores in response to the presence of a vehicle, e.g. when the sensor is configured to detect when a vehicle is in a predetermined proximity of a primary core such as in a position above the primary core.

Generally, the motor controllers and inverters or SSR may be arranged as integrated units with the LIMs or separate from the LIMs. For example, each motor controller and inverter/SSR may be adapted to control several LIMs, by switching the control to the LIM where a vehicle is present. This arrangement reduces installation costs but limits the number of vehicles that can be controlled simultaneously within a track section controlled by a motor controller.

In some embodiments, each motor controller (2;2*a*,2*b*) has a unique ID, e.g. a unique number, assigned to it, and zone controller 10 is configured to maintain a database of motor controllers in its zone including information about the ID and the position along the track of each motor controller (2;2*a*, 2*b*). Consequently, when each motor control 2 is associated with a sensor 8 for detecting vehicle presence and vehicle ID, the zone controller 10 can—upon receipt of a detection signal from a motor controller indicating the motor controller ID and the vehicle ID of a detected vehicle—recognize the position of each vehicle (1; 1*a*, 1*b*) based on the received motor controller IDs and vehicle IDs and based on the stored position information in the zone controller database. Furthermore, the zone controller can utilize the position information in the database so as to compute the distance between two vehicles.

Since the speed control loop including the sensor, the motor controller and the zone controller in the example of FIG. 3 involves wired communication, the reliability of the speed control is very high.

The motor controller further includes a wireless modem or other wireless communications interface 23 adapted to communicate with the vehicle controller 13 of a vehicle 1 in the proximity of the motor controller via a wireless transmitter or transceiver 29 and a corresponding wireless receiver or transceiver 19 of the vehicle.

The wireless communication may be performed via any suitable wireless data communications medium, e.g. by means of radio-frequency communication, in particular short-range radio communication. The motor controller 2 thus communicates, based on the information received from the zone controller 10, information about the confirmed free distance ahead of the vehicle to the next vehicle. For example, vehicle la in FIG. 1 maintains information about the confirmed free distance 11 to the vehicle 1*b*. At any time the vehicle controller 13 thus maintains at any time information about the free distance ahead of it. When the vehicle controller 13 subsequently, e.g. upon passing a subsequent motor controller, receives updated information about the free distance, the vehicle controller 13 updates the stored confirmed free distance.

The vehicle further includes a vehicle position sensor 28 for detecting its own position and speed. Based on the stored information about the confirmed free distance and based on the sensor signals from sensor 28, the vehicle controller determines when the vehicle 1 approaches the end of its confirmed free distance and actuates the emergency brake 21 in time to allow stopping of the vehicle before reaching the end of the confirmed free distance.

The sensor 28 may be based on any suitable mechanism for detecting the position and speed of the vehicle 1. For example, vehicle speed may be detected by wheel sensors e.g. by counting the number of revolutions of one or more wheels per unit time. Vehicle position may be detected by means of a radio transceiver that detects response signals from transponders located along the track, by means of a satellite based navigation system such as the Global Positioning System, or by any other suitable detection mechanism. Alternatively or additionally, the vehicle position may be determined by integrating the detected speed signal, and/or the like.

If the vehicle controller 13 does not receive a message from a motor controller causing the vehicle controller to update its stored confirmed free distance before the vehicle approaches the end of its currently confirmed free distance, the vehicle controller actuates the emergency brake.

It is an advantage that the vehicle controller 13 controls the emergency brake independently of the functioning of the motor and zone controllers, thereby increasing the safety of the system. On the other hand, a single failure of an individual vehicle position sensor or motor controller or communication link does not necessarily cause an emergency brake, as long as the vehicle controller receives an updated free distance from the next motor controller and before approaching the end of its currently confirmed free distance, thereby avoiding unnecessary interruptions of the operation of the system.

The vehicle controller 13 is further configured to send a periodic watchdog signal to the emergency brake 21. If the emergency brake 21 does not receive the watchdog signal for a predetermined period of time, the emergency brake 21 is configured to actuate itself, thereby providing safety against failure of the vehicle controller 13.

The speed control system of FIG. 4 is similar to the system of FIG. 3, except that in the system of FIG. 4, the position detection of the vehicles is based on the on-board position detection sensor 28. Hence, no in-track vehicle position sensors and corresponding signal processing logic are required. Accordingly, in the example of FIG. 4, the vehicle controller 13 is configured to transmit a vehicle ID, the current vehicle position and speed to the motor controller 2 via the transceiver 19 of the vehicle and the transceiver 29 and the wireless communications interface 23 of the motor controller. The communication may be a point-to-point communication between the vehicle and one of the motor controllers or a broadcast communication by the vehicle. For example, the vehicle may periodically broadcast its ID, position and speed via its transceiver 19 for receipt by a motor controller within the range of the wireless interface. The motor controller 2 forwards the received data to the zone controller 10, thereby allowing the zone controller to determine the free distance 11 of the vehicle 1 and the corresponding recommended speed. Even though still possible, the zone controller 10 does not need to rely on a database of motor controller positions for the determination of the vehicle position and free distance, since the zone controller receives the actual position data originating from the vehicle. The communication of the calculated free distance and the recommended speed and/or speed regulation command from the zone controller 10 to a motor controller 2 in a proximity of the vehicle position, the speed control by the motor controller 2, the forwarding of the free distance from the motor controller 2 to the vehicle controller 13, the emergency brake mechanism and the watchdog function are performed as described in connection with FIG. 3.

In alternative embodiments, the vehicle may transmit its position and speed directly to the zone controller via wireless communication and the zone controller may transmit the free distance directly to each vehicle.

In the following, the speed control process implemented by embodiments of the speed control system disclosed herein will now be described with reference to FIGS. 5-8 and continued reference to FIGS. 1-2 and 3-4.

FIGS. 5 and 6 show a flow diagrams of example of a speed control process performed by a motor controller of a speed control system, e.g. the process performed by the main control module 16 of the motor controller 2 described above.

Initially, in the example of FIG. 5, the process receives (S50) position information about a vehicle in a proximity of the motor controller, e.g. from in-track vehicle position sensors or from on-board vehicle position detection sensors so as to determine whether there is a vehicle in the proximity of the corresponding primary core 5 and to determine the vehicle ID of the detected vehicle. If a vehicle presence is detected, the process transmits (S51) data including an indication that a vehicle is detected and the corresponding vehicle ID and, preferably, the detected vehicle speed and direction to the zone controller 10 through communication cable 9. Subsequently, the process receives (S52) a speed command indicative of a target/recommended vehicle speed and/or indicative of a required speed adjustment, and information indicative of the free distance ahead of the detected vehicle from the zone controller. Based on the speed command, the process calculates one or more voltage/frequency commands and feeds the commands to the inverter 17 (S53). The calculation of the voltage/frequency may further be based on speed measurements of the vehicle speed of the detected vehicle received from the vehicle position sensor. Based on the measured speed and the received target speed, the motor controller determines the amount of desired acceleration or deceleration and calculates to the corresponding voltage/frequency command. The inverter thus produces the desired AC voltage with the desired frequency, e.g. by utilizing pulse width modulation technique, or phase-angle based switching, and delivers the AC power to the corresponding primary core (5;5*a*,5*b*) of the linear induction motor. It is understood that the calculation of the desired acceleration/deceleration may alternatively be performed by the zone controller. Finally, in step S54, the motor controller transmits the received information about the free distance to the vehicle controller of the detected vehicle.

In the example of FIG. 6, the process receives (S50) position information about a vehicle in a proximity of the motor controller, transmits (S51) vehicle data including vehicle position, speed and ID to the zone controller 10, and receives (S52) a speed command as described in connection with FIG. 5. In the example of FIG. 6, the process further determines (S55) a safe speed based on the received free distance, e.g. by means of a look-up table that relates free distance and safe speed. Optionally the look-up table includes further parameters such as vehicle mass, external conditions such as guideway gradient or the like. Alternatively or additionally, the determination may be performed based on a predetermined formula for calculating the estimated braking distance. The calculation of the braking distance may be based on the braking capacity of the LIMs and/or passenger comfort limitations, so as to ensure maintenance of a safe speed that allows braking without the need to invoke the emergency brake.

In some embodiments, in particular in embodiments where a single motor controller controls more than one LIM, the motor controller may store the received free distance and/or the received recommended speed of a vehicle at least as long as the vehicle is present within the section of the track that is controlled by the motor controller. Thus, the speed control may be performed efficiently and reliably even without reliance on an uninterrupted communication with the zone controller.

In step S56 the process determines whether the safe speed is smaller than the received recommended speed. If the safe speed is smaller than the recommended speed, the process determines a speed regulation based on the safe speed (S57), thus avoiding the need for unnecessary emergency brakes. Otherwise, the process determines a speed regulation based on the recommended speed (S58). Generally, the speed regulation may be based on a proportional, integrating and derivating (PID) control circuit of the motor controller. The PID control circuit may determine the thrust level, i.e. the desired acceleration times the vehicle mass to adjust the speed to the desired value. The vehicle mass may, for example, be determined by measuring the vehicles s acceleration performance during its start from a station and communicated to the respective vehicle or zone and motor controllers. The calculated thrust may be limited/modified by additional factors such as the specifications of the LIM, limitations so as to ensure passenger comfort, guideway gradient etc. Based on the determined speed regulation, the process calculates one or more voltage/frequency commands and feeds the commands to the inverter 17 (S53) or other thrust controller as described above. Finally, in step S54, the motor controller transmits the received information about the free distance to the vehicle controller of the detected vehicle.

Optionally each motor controller may communicate speed and thrust to the next downstream controller for smooth handover of control.

FIG. 7 shows a flow diagram of an example of a speed control process performed by a zone controller of a speed control system. In initial step S61, the zone controller 10 receives data from the motor or vehicle controller (2;2*a*, 2*b*), the data indicating vehicle position and vehicle ID and, optionally, speed and direction, of a vehicle that is passing or standing on that motor controller. Based on the position information and, optionally, based on stored information in a database of the zone controller about motor controllers in a designated zone, the zone controller calculates (S62) the relative distances between vehicles, and checks whether the vehicles maintain the minimum headway. Specifically, the decision whether the minimum headway is kept or not, is made by comparing the computed distance with a predetermined safe distance which may depend on the speed of the following vehicle. Based on the distance information, the zone controller determines (S63) a recommended speed for the vehicle so as to maintain safe distances and for merge control, e.g. at exits from stations. It is understood that the zone controller may implement alternative or additional strategies for controlling the speed of the vehicles within a zone so as to ensure maintenance of minimum headways and optimize the throughput and/or travel times in the system and to ensure passenger comfort in curves. In step S64, the zone controller transmits information about the recommended speed and the free distance ahead of a vehicle to the motor controller where the vehicle has been detected. It is understood that the zone controller may transmit the information about the free distance together with the above speed command or as a separate message. In one embodiment, the zone controller transmits the position of the vehicle 1*b* immediately ahead of the current vehicle 1*a* so as to indicate the end point of the free distance 11 ahead of the current vehicle 1*a*. In general, the free distance of a vehicle may be determined as the length of unoccupied track ahead of the vehicle, in particular the distance/position along the track to the first other vehicle immediately ahead of the vehicle.

Alternatively or additionally to transmitting the recommended speed, the zone controller may determine a recommended speed adjustment and transmit a corresponding speed adjustment command to the motor controller. For example, if the computed distance between a leading vehicle and a following vehicle is larger than the safe distance, the zone controller 10 may transmit a "higher-speed" command so as to accelerate the following vehicle or a "same-speed" command so as to maintain the same speed of the following vehicle to the corresponding motor controller 2 through a communication cable 9. On the other hand, in the case where the computed distance is shorter than the safe distance, the zone controller 10 transmits a "lower-speed" command so as to decelerate the following vehicle to the motor controller of the following vehicle.

Figure 8:
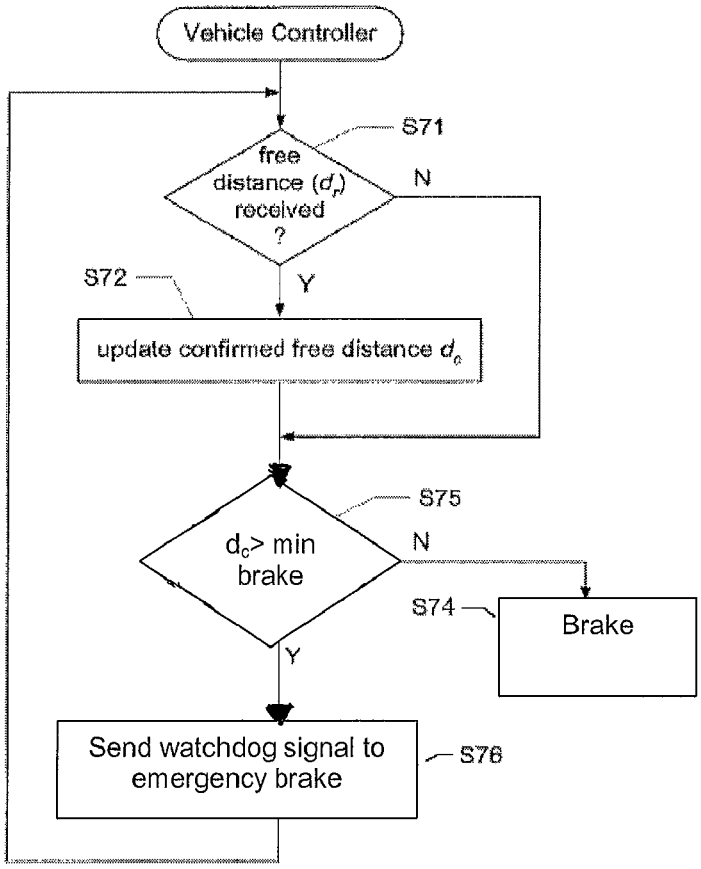
FIG. 8 shows a flow diagram of an example of a speed control process performed by a vehicle controller of a speed control system.

FIG. 8 shows a flow diagram of an example of a speed control process performed by a vehicle controller of a speed control system. In initial step S71, the vehicle controller checks whether the vehicle controller has received a message from a motor controller, the message being indicative of a free distance. If the vehicle controller has received such a message, the process proceeds at step S72. Preferably, the "free distance" is communicated as the position of the end of the free distance which is not affected by vehicle motion.

At step S72, i.e. when the vehicle controller has received a new message from a motor controller indicative of a free distance, the vehicle controller updates a value indicative of a confirmed free distance. In one embodiment, the confirmed free distance the vehicle controller only updates the free distance when it has been confirmed by at least two sensor indications or two messages received from a motor controller.

In the subsequent step S75, the vehicle controller determines whether the confirmed free distance is smaller than a predetermined brake distance within which the vehicle is able to brake. The predetermined brake distance may be a constant distance stored in the vehicle controller or a distance that depends on e.g. the current vehicle speed, the current weight of the vehicle and/or other parameters, e.g. the location of the vehicle on the track, guideway/track gradient or weather conditions. Generally, the brake distance will be smaller than the safe distance used for normal speed regulation as described above. If the confirmed free distance is larger than the brake distance, the process proceeds at step S76, otherwise the process proceeds at step S74 where the vehicle controller causes actuation of the emergency brake.

At step S76, the vehicle controller sends a watchdog signal to the emergency brake so as to indicate to the emergency brake that the vehicle controller is operating properly. Subsequently, the process returns to step S71 so as to check whether a message from a motor controller has been received.

When the watchdog is designed to send the watchdog signal only as long as the watchdog is addressed periodically by the vehicle controller, it is ensured that the vehicle brake is activated in case of failure in the vehicle controller which might affect its calculation of position and speed.

It is understood that the activation of the emergency brake may further be based on additional or alternative criteria. For example, the vehicle control system may activate the emergency brake after a predetermined delay time without reception of a signal from the motor controller and/or reception of an updated free distance. The delay time may depend on the speed of the vehicle so that the vehicle can stop within a predetermined distance.

In the above-mentioned exemplary embodiment of the present invention, since the propulsion power is delivered through an air gap to the reaction plate that is attached to the vehicle, power supply to the vehicle is not required. Accordingly, the installation of a power feeding means and a power collector mounted on the conventional on-board type linear induction motor is not required.

On-board Type Linear Induction Motor:

FIGS. 9 and 10 schematically show examples of a part of a personal rapid transit system with on-board type linear induction motor. The personal rapid transit system comprises a track, a section of which is schematically shown in FIGS. 9 and 10 designated by reference numeral 6. The track typically forms a network, typically including a plurality of merges, diverges and stations. The personal rapid transit system further includes a number of vehicles, generally designated by reference numeral 1. FIGS. 9 and 10 show a track section 6 with a vehicle 1. It is understood that a personal rapid transit system may include any number of vehicles. Generally, each vehicle typically includes a passenger cabin supported by a chassis or framework carrying wheels 22.

As mentioned above, the personal rapid transit system may comprise an on-board type linear induction motor including one or more primary cores, generally designated by reference numeral 5, arranged in each respective vehicle. Each vehicle has one or more LIMs mounted in the vehicle. The track-mounted reaction plate 7 is typically a metal plate made from aluminium, copper, or the like on a steel backing plate, e.g. in the form of a continuous plate arranged along the track. In such an embodiment, the vehicle receives power for driving the LIMs e.g. from the guideway, for example via suitable sliding contacts.

As will be described in greater detail below, each vehicle 1 includes a vehicle controller, generally designated 13, for controlling operation of the vehicle.

Each primary core 5 is controlled by a motor controller 2 which supplies a suitable AC power to the corresponding primary core so as to control the thrust for accelerating or decelerating the vehicle. The thrust is imparted by the primary core 5 on the reaction plate 7. To this end, each motor controller 2 includes an inverter or switching device that feeds a driving power to the primary core 5. The motor controller 2 controls the voltage/frequency of the driving power in accordance with an external control signal 9 from a zone controller 10 to the vehicle controller. The vehicle controller then transmits relevant signals to the motor controller.

In the on-board system the zone controller communicates with the vehicle controller 13 via wireless communication. The vehicle controller then communicates with the motor controller 2. Even though FIGS. 9 and 10 show the vehicle controller and the motor controller as two separate units having separate hardware, it is appreciated that the vehicle controller and the motor controller may be integrated into a single unit or even be embodied as two programmes executed on the same hardware.

Generally, the electromagnetic thrust generated between the plate 7 and the primary core 5 is proportional to the area of the air gap between the plate and the primary core, if conditions such as the density and the frequency of flux are the same.

It is an advantage of the on-board linear induction motors that the primary core 5 and the motor controller 2 are mounted on the vehicle, thereby obtaining smooth movement of the vehicle along the track. A further advantage of the on-board type is that typically fewer primary cores and motor controllers are needed, since each vehicle carries its own motor controller(s) and primary core(s), and hence a plurality of motor controllers and primary cores are not placed along the entire track.

Onboard motors need (and can be afforded) to be dimensioned for maximum acceleration and grade and then they have better performance, reducing the need to apply the emergency brake.

The system may further comprise one or more vehicle position detection sensors for detecting the position of the vehicles along the track. The position detection may take place in the track by means of position detection sensors 8, as shown in FIG. 9, or the position detection sensing may take place from the position detection sensor 28 in the vehicle, as shown in FIG. 10.

In the system of FIG. 9, vehicle position is detected by vehicle position sensors 8, adapted to detect the presence of a vehicle in a proximity of the respective sensors. The vehicle position sensors 8 are connected to the zone controller 10 and forward their respective detection signal to the zone controller. Even though only one vehicle position sensor 8 is shown in FIG. 9, it will be understood that there will typically be more than one sensor.

The vehicle position sensors may detect the vehicle presence by any suitable detection mechanism. In preferred embodiments, the vehicle position sensors detect further parameters such as vehicle speed, direction, and/or a vehicle ID.

The onboard sensors for position and speed may eliminate the need for sensors in the guideway.

The system further comprises one or more zone controllers 10 for controlling operation of at least a predetermined section or zone of the PRT system. Each zone controller communicates with the subset of the vehicle controllers 13 within the zone controlled by the zone controller 10 so as to allow data communication between the vehicle controller 13 with the corresponding zone controller 10, by means of wireless communication through a point-to-point communication, a bus system, a computer network, e.g. a local area network (LAN), or the like. Even though FIGS. 9 and 10 only depict a single zone controller, it is understood that a PRT system normally includes any suitable number of zone controllers. Different parts/zones of the system may be controlled by their respective zone controllers, thereby allowing an expedient scaling of the system as well as providing operation of the individual zones independently of each other. Furthermore, though not depicted in FIGS. 9 and 10, each zone controller 10 may be constructed as a plurality of individual controllers so as to provide a distributed control over vehicle controllers in a zone, e.g. vehicles currently present within a section of the track. Alternatively or additionally, a plurality of zone controllers may be provided for each zone so as to enhance the reliability through redundancy.

As will be described in greater detail below, in the example of FIG. 10 the zone controller 10—upon receipt of a suitable detection signal from a vehicle controller indicating the position and the vehicle ID of a detected vehicle—recognizes the position of each vehicle.

Furthermore, the zone controller computes the distance between two vehicles. The zone controller 10 thus determines respective desired/recommended speeds of two vehicles in accordance with the computed distance between the two vehicles, so as to maintain a desired minimum headway or safe distance between vehicles and so as to manage the overall traffic flow within the dedicated zone. The zone controller thus returns information about the free distance and the desired/recommended speed of a detected vehicle to the vehicle. Alternatively, the zone controller may determine a desired degree of speed adjustment and transmit a corresponding command to the vehicle.

Alternatively or additionally, speed may also be calculated by the motor controller based on a confirmed free distance. Thus, safe control does not depend on uninterrupted communication with the zone controller, since the motor controller may calculate the speed based on the last known free distance for the vehicle.

The PRT system further comprises a central system controller 20 connected to the zone controllers 10 so as to allow data communication between the zone controllers and the central system controller 20, e.g. as shown in FIG. 1 for an in-track system. The central system controller 20 may be installed in the control center of the PRT system and be configured to detect and control the running state of the overall system, optionally including traffic management tasks such as load prediction, routeing tables, empty vehicle management, passenger information, etc.

In particular, the vehicle controller 13 controls operation of one or more emergency brakes 21 installed in the vehicle 1. Even though other types of emergency brakes may be used, a mechanical emergency brake of the preloaded spring type has proven particularly reliable, as it does not require electrical or other power to be activated, thus providing a fail-safe emergency brake mechanism. In such a preloaded spring emergency brake, a spring is preloaded, e.g. by means of hydraulic or pneumatic pressure. The brake is actuated by removing the preload pressure thus causing the spring to expand and activate the brake, e.g. by pressing one or more brake blocks or clamps against the track 6 and/or the wheels 22.

Alternatively or additionally, in an on-board system, the on-board motor 5 may be used as an emergency brake. In such an embodiment, the vehicle may include an on-board energy source, e.g. a battery, connected to the motor 5 and having sufficient capacity for providing the energy required to emergency brake the vehicle independently of the normal energy supply of the motor 5 which typically receives its normal operating energy via the guideway/track.

The vehicle controller 13 comprises a transceiver and/or another communications interface 14 for transmitting/receiving data to/from the zone controller 10 via wireless communication. The vehicle controller 13 further includes a signal processing module 15. The motor controller 2 further includes a main control module 16 for outputting voltage/frequency commands to an inverter 17 or other thrust controller, e.g. an inverter or a switching device, in accordance with the instructions received by the vehicle controller 13 via wireless communication 14 from the zone controller 10. The inverter 17 or switching device supplies multi-phase AC power via power lines 24 to a corresponding primary core in accordance with the voltage/frequency commands from the main control module 16. The signal processing module 15 and the main control module 16 may be implemented as separate circuits/circuit boards or as a single circuit/circuit board, e.g. as an ASIC (Application Specific Integrated Circuit), a suitably programmed general purpose microprocessor, and/or the like.

The wireless communication between the zone controller and the vehicle controller may be performed via any suitable wireless data communications medium, e.g. by means of radio-frequency communication, in particular short-range radio communication. The vehicle controller 13 thus receives information about the confirmed free distance ahead of the vehicle to the next vehicle. At any time the vehicle controller 13 thus maintains information about the free distance ahead of it. When the vehicle controller 13 subsequently receives updated information about the free distance, the vehicle controller 13 updates the stored confirmed free distance.

The vehicle further includes a vehicle position sensor 28 for detecting its own position and speed. Based on the stored information about the confirmed free distance and based on the sensor signals from sensor 28, the vehicle controller determines when the vehicle 1 approaches the end of its confirmed free distance and actuates the emergency brake 21 in time to allow stopping of the vehicle before reaching the end of the confirmed free distance.

The sensor 28 may be based on any suitable mechanism for detecting the position and speed of the vehicle 1. For example, vehicle speed may be detected by wheel sensors e.g. by counting the number of revolutions of one or more wheels per unit time. Vehicle position may be detected by means of a radio transceiver that detects response signals from transponders located along the track, by means of a satellite based navigation system such as the Global Positioning System, or by any other suitable detection mechanism. Alternatively or additionally, the vehicle position may be determined by integrating the detected speed signal, and/or the like.

If the vehicle controller 13 does not receive a message from the zone controller causing the vehicle controller to update its stored confirmed free distance before the vehicle approaches the end of its currently confirmed free distance, the vehicle controller actuates the emergency brake.

It is an advantage that the vehicle controller 13 controls the emergency brake independently of the functioning of the zone controllers, thereby increasing the safety of the system. On the other hand, a single failure of an individual vehicle position sensor or communication link does not necessarily cause an emergency brake, as long as the vehicle controller receives an updated free distance before approaching the end of its currently confirmed free distance, thereby avoiding unnecessary interruptions of the operation of the system.

The vehicle controller 13 is further configured to send a periodic watchdog signal to the emergency brake 21. If the emergency brake 21 does not receive the watchdog signal for a predetermined period of time, the emergency brake 21 is configured to actuate itself, thereby providing safety against failure of the vehicle controller 13.

The vehicle controller 13 may include separate functional modules 602 and 603 for the normal speed control and the emergency brake control, respectively. Hence, if the normal speed control fails due to a failure in the speed control module 602, the emergency brake control still functions independently thereof. The modules 602 and 603 may be implemented as separate hardware units, e.g. separate ASICs, or as separate program modules executed on the same or on different hardware, e.g. as two independent control programs. In particular, the vehicle may include a separate energy source, e.g. a battery, 604 for providing the vehicle controller 13, or at least the emergency brake control module 603, with power independently of the power supply to the motor 5.

In an alternative embodiment, the position detection of the vehicles may be based on the on-board position detection sensor 28 connected to vehicle controller 13, as shown in FIG. 10. In FIG. 10 the vehicle controller communicates information to the zone controller about the vehicle, whereas in FIG. 9 the zone controller communicates information to the vehicle controller about the vehicle. Hence, in the system in FIG. 10 no in-track vehicle position sensors are required. Accordingly, the vehicle controller 13 is configured to transmit a vehicle ID, the current vehicle position and speed to the zone controller via wireless communication. The communication may be a point-to-point communication between the vehicle and one of the zone controllers or a broadcast communication by the vehicle. For example, the vehicle may periodically broadcast its ID, position and speed via its transceiver 19 for receipt by a zone controller within the range of the wireless interface, thereby allowing the zone controller to determine the free distance of the vehicle and the corresponding recommended speed. The communication of the calculated free distance and the recommended speed and/or speed regulation command from the zone controller 10 to the vehicle controller 13, the speed control by the motor controller 2, the emergency brake mechanism and the watchdog function are performed as previously described.

In the following, the speed control process implemented by embodiments of the speed control system disclosed herein will now be described with reference to FIGS. 11-14 and continued reference to FIGS. 9 and 10.

FIGS. 11 and 12 show flow diagrams of examples of a speed control process performed by the vehicle-based vehicle controller and/or motor controller of a speed control system.

FIG. 11 shows a first example of a speed control process in an on-board system. Initially, the process receives (S52) a speed command indicative of a target/recommended vehicle speed and/or indicative of a required speed adjustment, and information indicative of the free distance ahead of the vehicle from the zone controller. Based on the speed command, the process calculates one or more voltage/frequency commands and feeds the commands to the inverter 17 (S53). The calculation of the voltage/frequency may further be based on speed measurements of the vehicle speed of the vehicle received from the vehicle position sensor. Based on the measured speed and the received target speed, the process determines the amount of desired acceleration or deceleration and calculates to the corresponding voltage/frequency command. The inverter thus produces the desired AC voltage with the desired frequency, e.g. by utilizing pulse width modulation technique, and delivers the AC power to the corresponding primary core (5) of the linear induction motor. It is understood that the calculation of the desired acceleration/ deceleration may be performed by the vehicle controller and/or the motor controller. Alternatively the process may be performed by the zone controller.

The example shown in FIG. 12 is similar to the process shown in FIG. 11. However, in the example of FIG. 12, the process further determines (S55) a safe speed based on the received free distance, e.g. by means of a look-up table that relates free distance and safe speed. Optionally the look-up table includes further parameters such as vehicle mass, external conditions such as guideway gradient or the like. Alternatively or additionally, the determination may be performed based on a predetermined formula for calculating the estimated braking distance. The calculation of the braking distance may be based on the braking capacity of the LIMs and/or passenger comfort limitations, so as to ensure maintenance of a safe speed that allows braking without the need to invoke the emergency brake.

In step S56 the process determines whether the safe speed is smaller than the received recommended speed. If the safe speed is smaller than the recommended speed, the process determines a speed regulation based on the safe speed (S57), thus avoiding the need for unnecessary emergency brakes. Otherwise, the process determines a speed regulation based on the recommended speed (S58). Generally, the speed regulation may be based on a proportional, integrating and derivating (PID) control circuit of the motor controller. The PID control circuit may determine the thrust level, i.e. the desired acceleration times the vehicle mass to adjust the speed to the desired value. The vehicle mass may, for example, be determined by measuring the vehicle's acceleration performance during its start from a station and communicated to the respective vehicle. The calculated thrust may be limited/modified by additional factors such as the specifications of the LIM, limitations so as to ensure passenger comfort, guideway gradient etc. Based on the determined speed regulation, the process calculates one or more voltage/frequency commands and feeds the commands to the inverter 17 (S53) or other thrust controller as described above.

FIG. 13 shows a flow diagram of an example of a speed control process performed by a zone controller of a speed control system. In initial step S61, the zone controller 10 receives data from the vehicle controller 13 and/or the track-based sensor 8, as the case may be, the data indicating vehicle position and vehicle ID and, optionally, speed and direction, of a vehicle. Based on the position information and stored information about the positions of other vehicles in a predetermined zone, the zone controller calculates (S62) the relative distances between vehicles, and checks whether the vehicles maintain the minimum headway. Specifically, the decision whether the minimum headway is kept or not, is made by comparing the computed distance with a predetermined safe distance which may depend on the speed of the following vehicle and optionally on the speed of the leading vehicle. Based on the distance information, the zone controller determines (S63) a recommended speed for the vehicle so as to maintain safe distances and for merge control, e.g. at exits from stations. It is understood that the zone controller may implement alternative or additional strategies for controlling the speed of the vehicles within a zone so as to ensure maintenance of minimum headways and optimize the throughput and/or travel times in the system and to ensure passenger comfort in curves. In step S64, the zone controller transmits information about the recommended speed and the free distance ahead of a vehicle to the vehicle. It is understood that the zone controller may transmit the information about the free distance together with the above speed command or as a separate message. In one embodiment, the zone controller transmits the position of one vehicle immediately ahead of the current vehicle so as to indicate the end point of the free distance ahead of the current vehicle. In general, the free distance of a vehicle may be determined as the length of unoccupied track ahead of the vehicle, in particular the distance/position along the track to the first other vehicle immediately ahead of the vehicle.

Alternatively or additionally to transmitting the recommended speed, the zone controller may determine a recommended speed adjustment and transmit a corresponding speed adjustment command to the vehicle controller. For example, if the computed distance between a leading vehicle and a following vehicle is larger than the safe distance, the zone controller 10 may transmit a "higher-speed" command so as to accelerate the following vehicle or a "same-speed" command so as to maintain the same speed of the following vehicle through a wireless communication 9. On the other hand, in the case where the computed distance is shorter than the safe distance, the zone controller 10 transmits a "lower-speed" command so as to decelerate the following vehicle.

Figure 14:
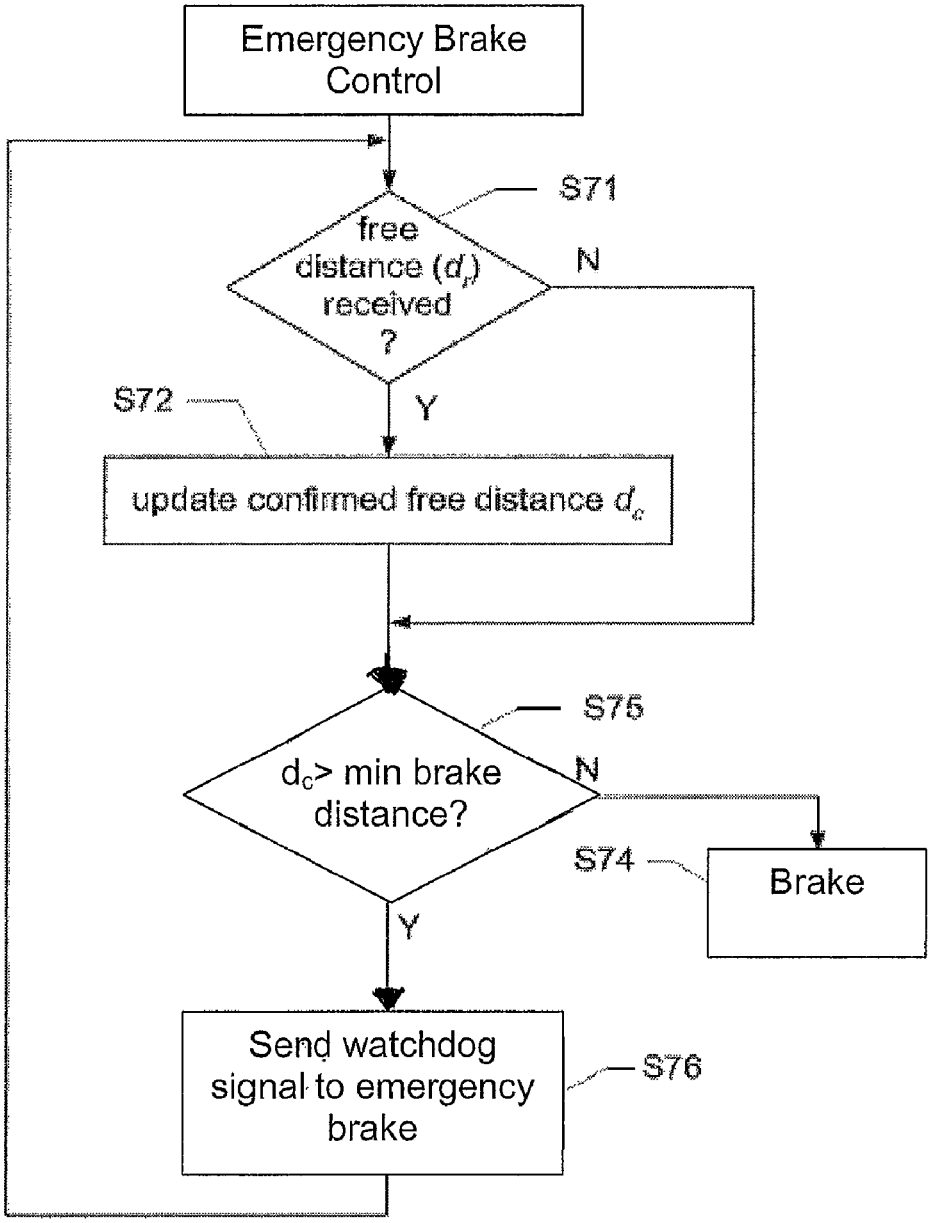
FIG. 14 shows a flow diagram of an example of an emergency brake control process performed by a vehicle controller of a speed control system.

FIG. 14 shows a flow diagram of an example of an emergency brake control process performed by a vehicle controller of a speed control system. In initial step S71, the vehicle controller checks whether the vehicle controller has received a message, the message being indicative of a free distance. If the vehicle controller has received such a message, the process proceeds at step S72. Preferably, the "free distance" is communicated as the position of the end of the free distance which is not affected by vehicle motion.

At step S72, i.e. when the vehicle controller has received a new message indicative of a free distance, the vehicle controller updates a value indicative of a confirmed free distance. In one embodiment, the vehicle controller only updates the free distance when it has been confirmed by at least two sensor indications or two messages.

In subsequent step S75, the vehicle controller determines whether the confirmed free distance is smaller than a predetermined brake distance within which the vehicle is able to brake. The predetermined brake distance may be a constant distance stored in the vehicle controller or a distance that depends on e.g. the current vehicle speed, the current weight of the vehicle and/or other parameters, e.g. the location of the vehicle on the track, guideway gradient or weather conditions. Generally, the brake distance will be smaller than the safe distance used for normal speed regulation as described above. If the confirmed free distance is larger than the brake distance, the process proceeds at step S76, otherwise the process proceeds at step S74 where the vehicle controller causes actuation of the emergency brake.

At step S76, the vehicle controller sends a watchdog signal to the emergency brake so as to indicate to the emergency brake that the vehicle controller is operating properly. Subsequently, the process returns to step S71 so as to check whether a message has been received.

When the watchdog is designed to send the watchdog signal only as long as the watchdog is addressed periodically by the vehicle controller, it is ensured that the vehicle brake is activated in case of failure in the vehicle controller which might affect its calculation of position and speed.

It is understood that the activation of the emergency brake may further be based on additional or alternative criteria. For example, the vehicle control system may activate the emergency brake after a predetermined delay time without reception of a signal from the motor controller and/or reception of an updated free distance. The delay time may depend on the speed of the vehicle so that the vehicle can stop within a predetermined distance.

Although some embodiments have been described and shown in detail, the invention is not restricted to them, but may also be embodied in other ways within the scope of the subject matter defined in the following claims.

The method and control systems described herein and, in particular, the vehicle controller, zone controller, and motor controller described herein can be implemented by means of hardware comprising several distinct elements, and by means of a suitably programmed microprocessor or other processing means. The term processing means comprises any circuit and/or device suitably adapted to perform the functions described herein, e.g. caused by the execution of program code means such as computer-executable instructions. In particular, the above term comprises general- or special-purpose programmable microprocessors, Digital Signal Processors (DSP), Application Specific Integrated Circuits (ASIC), Programmable Logic Arrays (PLA), Field Programmable Gate Arrays (FPGA), special purpose electronic circuits, etc., or a combination thereof.

If the device claims enumerate several means, several of these means can be embodied by one and the same item of hardware, e.g. a suitably programmed micro-processor, one or more digital signal processors, or the like. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A speed control system for controlling vehicle speed of one or more vehicles in a personal rapid transit system when said one or more vehicles travel along a track, the personal rapid transit system including a vehicle propulsion system including one or more motors, each motor being adapted to generate a thrust for propelling one of the one or more vehicles, the speed control system comprising:

a speed regulation subsystem adapted to control the thrust generated by at least one of said motors based on one or more sensor signals received from vehicle position or and/or speed sensors, so as to control the speed of the one or more vehicles;

a vehicle control system included in each of said one or more vehicles and adapted to activate, independently from the speed control by the speed regulation subsystem, an emergency brake mounted on said vehicle, wherein the vehicle control system is adapted to receive recurrent signals from a zone control system for controlling at least a part of the rapid transit system, wherein the vehicle control system is adapted to activate the emergency brake after a predetermined delay time without reception of said recurrent signal, and wherein the delay time depends on the speed of the vehicle so that the vehicle can stop within a predetermined distance.

2. The speed control system according to claim 1, wherein the personal rapid transit system includes an in-track vehicle propulsion system including a plurality of motors positioned along said track, each motor being adapted to generate a thrust for propelling one of the one or more vehicles, when said vehicle is in the proximity of said motor.

3. The speed control system according to claim 1, wherein the personal rapid transit system includes an on-board type vehicle propulsion system wherein each vehicle comprises at least one of said motors.

4. The speed control system according to claim 1, wherein the emergency brake is a mechanical brake including a brake member for frictionally engaging the track.

5. The speed control system according to claim 4, wherein the emergency brake comprises a preloaded spring member held back by a preload pressure.

6. The speed control system according to claim 1, wherein the sensor signals include signals indicative of at least vehicle speed and vehicle position.

7. The speed control system according to claim 1, wherein the propulsion system is a linear induction motor system comprising one or more linear induction motors and wherein the generated thrust is conveyed to the vehicle by electromagnetic force acting on a reaction plate.

8. The speed control system according to claim 7, wherein the plurality of linear induction motors are positioned along the track and wherein the reaction plate is mounted on the vehicle.

9. The speed control system according to claim 7, wherein the one or more linear induction motors are positioned on the vehicle and wherein the reaction plate is mounted on the track.

10. The speed control system according to claim 1, wherein the recurrent signal is indicative of an end point of a free distance ahead of the vehicle; and wherein the vehicle control system is adapted to activate the emergency brake, if the distance from a current position to the end point is smaller than a predetermined threshold distance.

11. The speed control system according to claim 1, wherein the recurrent signals are indicative of a free distance ahead of said vehicle, and wherein the vehicle control system is adapted to receive sensor signals indicative of the speed and current position of the vehicle and to determine a need for activating the emergency brake based on the speed, the current position, and the free distance.

12. The speed control system according to claim 1, wherein the vehicle control system is adapted to accept a free distance as a confirmed free distance only if at least two of said received recurrent signals have indicated said free distance.

13. The speed control system according to claim 1, wherein the speed regulation subsystem includes one or more motor controllers, wherein each motor controller is adapted to control at least one of the one or more motors; and at least one zone controller adapted to receive said sensor signals and to generate speed commands for causing motor controllers to adjust the speed of respective vehicles.

14. The speed control system according to claim 13, wherein the one or more motor controllers are positioned along the track and wherein the zone controller is adapted to transmit the speed commands to the respective motor controller.

15. The speed control system according to claim 14, wherein the zone controller is adapted to forward information about a free distance ahead of a vehicle positioned in a proximity of a motor controller to said motor controller, and wherein the motor controller is adapted to forward the information to said vehicle.

16. The speed control system according to claim 13, wherein the one or more motor controllers are positioned in respective vehicles, and wherein the at least one zone controller is adapted to transmit the speed commands to respective ones of the vehicle controllers so as to cause each vehicle controller to communicate to a corresponding motor controller to adjust the speed of the corresponding vehicle.

17. The speed control system according to claim 13, wherein the zone controller is adapted to forward information about a free distance ahead of a vehicle to said vehicle and receives position and speed information from each vehicle.

18. The speed control system according to claim 13, wherein each of the zone controllers and each of the motor controllers are composed of two respective redundant subsystems.

19. The speed control system according to claim wherein each vehicle comprises at least two redundant vehicle controllers.

20. The speed control system according to claim 1, wherein the vehicle control system is adapted to send recurrent watchdog signals to the emergency brake, and wherein the emergency brake is adapted to activate when the emergency brake has not received a watchdog signal from the vehicle control system for a predetermined period of time.

21. The speed control system according to claim 1, wherein the vehicle control system includes a watchdog module being addressed periodically during operation from the vehicle control system and adapted to activate the emergency brake if the watchdog module has not been addressed for a predetermined period of time.

22. The speed control system according to claim 1, wherein the speed regulation subsystem includes:

a) a linear induction motor including one or more primary cores, each primary core being arranged to provide propulsion to a vehicle moving along a track;

b) one or more vehicle position sensors adapted to detect at least a position of the vehicle;

c) one or more motor controllers, wherein each motor controller is adapted to control one or more respective primary cores; and d) a zone controller adapted to identify the position of each vehicle in a predetermined zone based on data received from the vehicle position sensors, to compute the distance between two consecutive vehicles and to generate vehicle speed commands for causing one or more of the motor controllers to adjust the speed of respective vehicles so as to maintain a safe headway between consecutive vehicles or and/or to optimize vehicle flow in said zone.

23. The speed control system according to claim 1, wherein the linear induction motors and the motor controllers are arranged along the track, and where the zone controllers are adapted to communicate with the motor controllers.

24. The speed control system according to claim 1, wherein the linear induction motors and the motor controllers are included in respective vehicles, and wherein the zone controllers are adapted to communicate with the vehicle controllers.

25. A personal rapid transit system including a speed control system as defined in claim 1.

26. A speed control system for controlling vehicle speed in a personal rapid transit system, the speed control system comprising:

a) a linear induction motor including one or more primary cores, each primary core being arranged to provide propulsion to a vehicle moving along a track;

b) one or more vehicle position sensors adapted to detect at least a position of the vehicle;

c) one or more motor controllers, wherein each motor controller is adapted to control one or more respective primary cores; and d) a zone controller adapted to identify the position of each vehicle in a predetermined zone based on data received from the vehicle position sensors, to compute the distance between two consecutive vehicles and to generate vehicle speed commands for causing one or more of the motor controllers to adjust the speed of respective vehicles so as to maintain a safe headway between consecutive vehicles or to optimize vehicle flow in said zone, wherein the speed control system is adapted to receive recurrent signals from a zone control system for controlling at least a part of the rapid transit system, wherein the speed control system is adapted to activate an emergency brake after a predetermined delay time without reception of said recurrent signal, and wherein the delay time depends on the speed of the vehicle so that the vehicle can stop within a predetermined distance.

27. The speed control system according to claim 26, wherein each motor controller includes a thrust controller for supplying multi-phase AC voltage to the terminals of a corresponding one of the primary cores, a control circuit adapted:

to send the vehicle detection data to the zone controller via a communication, to receive vehicle speed commands from the zone controller via said communication, and to produce a voltage/frequency command to the thrust controller.

28. The speed control system according to claim 27, wherein the communication is a wired connection.

29. The speed control system according to claim 27, wherein the motor controller including the control circuit, and the thrust controller is integrated as a single unit.

30. The speed control system according to claim 29, wherein a plurality of such units is arranged along a track.

31. The speed control system according to claim 30, wherein one of such integrated units is located at each location of a primary core of the linear induction motor.

32. The speed control system according to claim 31, wherein each primary core is arranged as an integral unit including the primary core and a motor controller.

33. The speed control system according to claim 27, wherein each motor controller comprises at least one communication unit for providing data communication with the zone controller by sending the vehicle information data and by receiving a vehicle speed command, wherein the control circuit is further adapted to produce a voltage/frequency command to a thrust controller based on the speed command received from the zone controller.

34. The speed control system according to claim 27, wherein the zone controller is adapted to manage a database based on the received data from the position sensors in the predetermined zone, the database having stored therein information on vehicle position, speed, direction, and ID of each vehicle in that zone, and wherein the zone controller is adapted to identify the vehicle position and to compute the distance between vehicles based on the positions of the recognized vehicles, and wherein the zone controller is adapted to identify the vehicle position by associating a vehicle ID with an ID of the motor controller from which the zone controller has received said data.

35. The speed control system according to claim 27, wherein the vehicle position sensors are adapted to detect at least a vehicle position and a vehicle speed, wherein the control circuit is further adapted to determine the voltage/frequency command based on the received vehicle speed command and the vehicle speed data.

36. The speed control system according to claim 27, wherein the thrust controller is an inverter for providing multi-phase AC power to the respective primary cores in accordance with the voltage/frequency command generated from the control circuit.

37. The speed control system according to claim 26, wherein each motor controller includes a thrust controller for supplying multi-phase AC voltage to the terminals of a corresponding one of the primary cores, wherein the motor controller is adapted to communicate with the vehicle controller, and wherein the vehicle controller is adapted to send data to the zone controller, wherein the vehicle controller comprises a control circuit adapted to send the vehicle detection data to the zone controller via a communication connection, to receive vehicle speed commands from the zone controller via said communication connection, and to produce a voltage/frequency command to the thrust controller.

38. The speed control system according to claim 37, wherein the communication connection is a wireless connection.

39. The speed control system according to claim 37, wherein each vehicle controller comprises at least one communication unit for providing data communication with the zone controller by sending the vehicle information data and by receiving a vehicle speed command, wherein the control circuit is further adapted to produce a voltage/frequency command to a thrust controller based on the speed command received from the zone controller.

40. The speed control system according to claim 26, wherein each vehicle position sensor is adapted to provide information on one or more of the following: vehicle position, vehicle speed, vehicle direction, and a vehicle ID.

41. The speed control system according to claim 26, wherein the zone controller is adapted to manage a database based on the received data from the position sensors in the predetermined zone, the database having stored therein information on vehicle position, speed, direction, and ID of each vehicle in that zone, and wherein the zone controller is adapted to identify the vehicle position and to compute the distance between vehicles based on the positions of the recognized vehicles.

42. The speed control system according to claim 26, wherein the zone controller is adapted to send an end position of a safe distance to each vehicle and wherein the vehicle is programmed to activate an emergency brake before the end of the corresponding safe distance.

43. A vehicle for a personal rapid transit system, the personal rapid transit system including a propulsion system including one or more motors, each motor being adapted to generate a thrust for propelling the vehicle, the rapid transit system further comprising a speed regulation subsystem adapted to control the thrust generated by at least one of said motors so as to control the speed of the vehicle based on one or more sensor signals received from respective vehicle position or and/or speed sensors; the vehicle comprising: a vehicle control system included in said vehicle and adapted to activate, independently from the speed control by the speed regulation subsystem, an emergency brake mounted on said vehicle, wherein the vehicle control system is adapted to receive recurrent signals from a zone control system for controlling at least a part of the rapid transit system, wherein the vehicle control system is adapted to activate the emergency brake after a predetermined delay time without reception of said recurrent signal, and wherein the delay time depends on the speed of the vehicle so that the vehicle can stop within a predetermined distance.

44. The vehicle for a personal rapid transit system according to claim 43, wherein the personal rapid transit system includes an in-track type vehicle propulsion system including a plurality of motors positioned along a track along which the vehicle is adapted to move, wherein the vehicle includes a reaction plate, each motor being adapted to generate thrust with the reaction plate for propelling the vehicle when said vehicle is in a proximity of said motor.

45. The vehicle for a personal rapid transit system according to claim 43, wherein the personal rapid transit system includes an on-board type vehicle propulsion system; wherein the vehicle includes the one or more motors.

46. A method of controlling vehicle speed of one or more vehicles in a personal rapid transit system when said one or more vehicles travel along a track, the personal rapid transit system including a vehicle propulsion system including one or more motors, each motor being adapted to generate a thrust for propelling one of the one or more vehicles, the method comprising:

detecting at least a position of one of the one or more vehicles;

controlling the thrust generated by at least one of said motors so as to control the speed of the one or more vehicles based on at least said sensor signal;

providing a vehicle control system included in said vehicle and adapted to activate, independently from said speed control, an emergency brake mounted on said vehicle;

receiving recurrent signals from a zone control system for controlling at least a art of the rapid transit system; and activating the emergency brake after a predetermined delay time without reception of said recurrent signal, wherein the delay time depends on the speed of the vehicle so that the vehicle can stop within a predetermined distance.

47. A method of controlling vehicle speed in a personal rapid transit system having a linear induction motor including one or more primary cores for generating electro-magnetic thrust to the reaction plate, the primary cores being controlled by respective motor controllers, the method comprising the steps of:

a) detecting the position and speed of the respective vehicles;

b) communicating the detected positions and speeds to a zone controller;

c) computing the distance between the vehicles by a zone controller based on the detected positions of the vehicles;

d) instructing at least one of the motor controllers by the zone controller to adjust the speed of at least one vehicle in accordance with the computed distance between the vehicles;

e) receiving recurrent signals from a zone control system for controlling at least a part of the rapid transit system; and f) activating an emergency brake after a predetermined delay time without reception of said recurrent signal, wherein the delay time depends on the speed of the vehicle so that the vehicle can stop within a predetermined distance.

* * * * *

UNITED STATES PATENT AND TRADEMARK OFFICE

CERTIFICATE OF CORRECTION

PATENT NO. : 8,335,627 B2
APPLICATION NO. : 12/299789
DATED : December 18, 2012
INVENTOR(S) : Hyoung Min Cho et al.

It is certified that error appears in the above-identified patent and that said Letters Patent is hereby corrected as shown below:

Column 21, Line 40, Claim 1, before "speed" delete "and/or"

Column 23, Line 5, Claim 19, delete "claim" and insert -- claim 1 --

Column 23, Line 39, Claim 22, after "or" delete "and/or"

Column 25, Line 53, Claim 43, after "or" delete "and/or"

Column 26, Line 32, Claim 46, delete "art" and insert -- part --

Signed and Sealed this
Twelfth Day of March, 2013

Teresa Stanek Rea

Teresa Stanek Rea
*Acting Director of the United States Patent and Trademark Office*